US012752827B2

(12) United States Patent
McKenney et al.

(10) Patent No.: US 12,752,827 B2
(45) Date of Patent: Oct. 6, 2026

(54) INTRUSION DETECTION

(71) Applicant: International Electronic Machines Corp., Troy, NY (US)

(72) Inventors: Bruce McKenney, Selkirk, NY (US); Marc R. Pearlman, Clifton Park, NY (US); Joshua Johnson, Troy, NY (US); Anuj R. Nadig, Falmouth, MA (US); Zahid F. Mian, Loudonville, NY (US)

(73) Assignee: International Electronic Machines Corp., Troy, NY (US)

( * ) Notice: Subject to any disclaimer, the term of this patent is extended or adjusted under 35 U.S.C. 154(b) by 1127 days.

(21) Appl. No.: 17/666,067

(22) Filed: Feb. 7, 2022

(65) Prior Publication Data

US 2022/0242465 A1 Aug. 4, 2022

Related U.S. Application Data

(63) Continuation of application No. PCT/US2022/015194, filed on Feb. 4, 2022.

(60) Provisional application No. 63/145,958, filed on Feb. 4, 2021.

(51) Int. Cl.

| | |
|---|---|
| ***B61L 23/04*** | (2006.01) |
| ***B61L 15/00*** | (2006.01) |
| ***B61L 27/20*** | (2022.01) |
| ***B61L 27/70*** | (2022.01) |
| ***B61L 29/30*** | (2006.01) |

(52) U.S. Cl.

CPC ..... *B61L 23/041* (2013.01); *B61L 15/0027* (2013.01); *B61L 27/20* (2022.01); *B61L 27/70* (2022.01); *B61L 29/30* (2013.01)

(58) Field of Classification Search

CPC ..... B61L 23/041; B61L 27/20; B61L 27/70; B61L 15/0027; B61L 29/30

See application file for complete search history.

(56) References Cited

U.S. PATENT DOCUMENTS

| | | | |
|---|---|---|---|
| 4,952,939 | A | 8/1990 | Seed |
| 5,194,848 | A | 3/1993 | Kerr |
| 5,774,045 | A | 6/1998 | Helma et al. |
| 6,271,754 | B1 | 8/2001 | Durtler |
| 6,933,858 | B2 | 8/2005 | Pieralli |
| 7,245,217 | B2 | 7/2007 | Tsai |

(Continued)

FOREIGN PATENT DOCUMENTS

| | | | | |
|---|---|---|---|---|
| CN | 118289066 | A * | 7/2024 | |
| DE | 102019209484 | A1 * | 12/2020 | |
| WO | WO-2021166372 | A1 * | 8/2021 | ..... B60L 15/40 |

OTHER PUBLICATIONS

International Search Report and Written Opinion for International Application No. PCT/US2022/015194, Sep. 13, 2022, 18 pages.

*Primary Examiner* — Jason C Smith

(74) *Attorney, Agent, or Firm* — LaBatt, LLC

(57) ABSTRACT

A solution for detecting and alerting to intrusions or obstacles in an area. One or more sensing devices can be used in combination with computer processing capabilities to monitor an area for intrusions or obstacles. An illustrative area is part of a railyard or railroad track, which can be monitored for intrusions by foot, vehicle, or even by inanimate objects such as falling rocks from a track cut. The sensing, computing, and/or alerting systems can be redundant to ensure operation at all times.

20 Claims, 21 Drawing Sheets

(56) References Cited

U.S. PATENT DOCUMENTS

| | | | | |
|---|---|---|---|---|
| 7,295,111 | B2 | 11/2007 | Pieralli | |
| 7,439,876 | B2 | 10/2008 | Pieralli et al. | |
| 7,576,648 | B2 | 8/2009 | Harman | |
| 7,715,276 | B2 | 5/2010 | Agam et al. | |
| 9,135,796 | B2 | 9/2015 | Kalo et al. | |
| 9,610,894 | B2 * | 4/2017 | Engel | B60Q 9/008 |
| 10,179,597 | B2 | 1/2019 | Wade | |
| 10,202,135 | B2 * | 2/2019 | Mian | G06V 20/52 |
| 10,286,930 | B2 * | 5/2019 | Simon | H04N 23/90 |
| 10,507,854 | B2 * | 12/2019 | DeJarnatt | B61L 29/24 |
| 10,518,700 | B1 * | 12/2019 | Engel | B61L 27/53 |
| 10,611,388 | B2 * | 4/2020 | Chung | B61L 25/025 |
| 10,822,008 | B2 | 11/2020 | Wade | |
| 2018/0222507 | A1 * | 8/2018 | DeJarnatt | B61L 29/32 |
| 2022/0242465 | A1 * | 8/2022 | McKenney | B61L 27/33 |
| 2022/0388554 | A1 * | 12/2022 | Frucht | G01S 17/04 |

* cited by examiner

1100

1105

INTRUSION DETECTION

REFERENCE TO RELATED APPLICATIONS

The current application is a continuation of International Patent Application No. PCT/US2022/015194, filed on 4 Feb. 2022, which claims the benefit of U.S. Provisional Application No. 63/145,958, filed on 4 Feb. 2021, each of which is hereby incorporated by reference.

TECHNICAL FIELD

The present disclosure relates, generally, to the field of intrusion detection in an area. In an embodiment, a sensor system is provided with multiple solutions to detect intrusions of people and/or objects into a railroad right-of-way and alert appropriate persons of such events. Other embodiments are also described.

BACKGROUND ART

Railroad track intrusion detection is becoming an important part of railway transportation systems, especially high-speed railway systems, where any obstruction on the right of way can be catastrophic. As the world continues to move in the direction of mass transit systems, it is ever more important to ensure that the transit systems are safe to operate at all speeds.

While many attempts using various technologies have been tried to create a train intrusion detection system, these attempts fall short for a variety of reasons.

The present approaches suffer from one or more of the following issues: (1) Unacceptably high false alarm rate from false detections, such as when an alarm is caused by an object which should not have triggered the alarm, e.g., tumble weed, growing grass, small plants popping up, seasonal weed, empty card board boxes, blowing trash, birds, small/large animals crossing the track, etc.; (2) No clear method to verify if an alarm is worthy of taking an action, e.g., no feedback to a central operator to detect an alarming situation and then act on verification before or during an alert is sent to the train operator or train control system; (3) Limited ability of the present systems to operate in all weather conditions including but not limited to fog, rain, snow, dust/sandstorms, etc.; (4) Ability to operate in all types of train operations, e.g., day time, night time, 24 hours a day for 7 days every week, before a train approaches, during train passage, and in vicinity of other traffic on nearby or adjacent tracks, bridges, crossings, track connections, track sidings, etc.

Present offerings also generally focus on using a single modality, while it is clear that there are huge benefits from fusing different technologies, as shown in applicant's prior patent, U.S. Pat. No. 10,202,135, "Operations monitoring in an area". These benefits are often non-obvious even to those skilled in the art of intrusion detection.

A large number of existing systems also do not provide Safety Integrity Level 4 (SIL-4) certification which is a requirement for deployment into several settings, including that of railroads. SIL-4 certification requires an extremely low chance of failure, and even lower chance of failure which could result in adverse consequences. SIL-4 implementation has many implications for a system architecture, approach, and design.

In prior art, U.S. Pat. No. 10,518,700, "Instrusion detection system and methods thereof" (misspelling of "intrusion" in official patent title), and U.S. Pat. No. 9,610,894, "Intrusion detection system and methods thereof", a device is described which is designed to work in a transit platform where multiple scanners are used to create upper and lower scanner layers. These patents fail to address long range obstructions, obstructions detection in fog, rain, snow, and many of the key elements needed to make solutions work in real life.

In patents U.S. Pat. Nos. 10,822,008 and 10,179,597, both titled "Automated wayside asset monitoring with optical imaging and visualization", a camera-based device is described which is used to locate objects from a moving maintenance of way (MoW) vehicle. The patent does not address overall system reliability. Furthermore, it relies solely on camera imagery for inputs to its intrusion algorithm detection. Other forms of environmental sensing, including but not limited to vibration monitors and soil stability sensors are not considered.

U.S. Pat. No. 9,135,796, "Intrusion detection system and its sensors", describes a system in which a physical barrier is fitted with a sensor array. These sensors are used to detect fence vibration which is processed to detect an intrusion. This patent does not describe a barrier-less method to detect intrusion and a situation where an object is thrown over a fence to land in an area to be protected.

In another example of prior art, U.S. Pat. No. 7,715,276, "Presence detection system for path crossing", a railway grade-crossing obstruction detector which is activated by ultrasonic sensors is described. These ultrasonic sensors are susceptible to false alarms from falling objects, snow falls, etc. which is not acceptable for real life, practical implementation.

In U.S. Pat. No. 7,576,648, "Cable guided intrusion detection sensor, system and method", an electromagnetic field is induced in a cable and then detecting any disturbance in the field from an intruder is described. The patent requires a cable to be installed and is more useful in detecting a fenced area where a cable can be installed thereby created an electromagnetic field fence.

U.S. Pat. No. 7,439,876, "Microwave detection system and method", U.S. Pat. No. 7,295,111, "Microwave detection system and method for detecting intrusion to an off-limits zone", and U.S. Pat. No. 6,933,858, "System and method for detecting obstacles within the area of a railroad grade crossing using a phase modulated microwave signal", describe a microwave transmitter-receiver pair which are used to detect any railway crossing obstruction by locating the microwave pairs in a "X" pattern. The field covered by these transmitter-receiver pairs are limited in width and will require many pairs to be installed along a lengthy rail line for full coverage.

In U.S. Pat. No. 7,245,217, "Hazard mitigation for railway track intrusions at train station platform", a compressible sensor layer is described which can determine if an object has fallen on the layer. The patent is limited by nature to a very small, specific area and thus cannot be used for wide-area coverage.

In U.S. Pat. No. 6,271,754, "Method and system for detecting an intrusion in a particular region", a cable is fitted with a transmitter and receiver on either end to detect if the cable is being disturbed. This implementation requires that a cable is used as a means to transmit and sense electrical signal disturbance occurring within the cable length.

In U.S. Pat. No. 5,774,045, "Arrangement for detecting objects in a region to be monitored", a system is described where a pulsed radar or FMCW signals are used on either end of the region to be protected. The patent requires that the region is surrounded by radar beacons similar to earlier discussed patents.

In U.S. Pat. No. 5,194,848, "Intrusion detection apparatus having multiple channel signal processing", a signal processor is described which uses multiple filter bands to categorize vibration signal from an intrusion. The patent covers a signal processor to systematically categorize sensor signals.

In U.S. Pat. No. 4,952,939, "Radar Intrusion Detection System", a microwave sensor-based intrusion detection system is used to detect intrusions. The patent covers yet another microwave sensor-based scheme to detect area intrusion.

The above list of prior art cover a wide range of technologies including but not limited to microwave sensors, ultrasonic sensors, camera imaging, etc.

SUMMARY

The inventors recognize that the prior art does not address the special intrusion detection needs for a long range, open area, train track intrusion challenge in an effective and cost conscious manner. An embodiment of the following invention covers an innovative method to ensure the track safety against falling objects, human trespassers, track intrusion from derailed trains operating in nearby tracks, etc. and other causes which can result in damage, injury or derailment for train operations. A more particular embodiment of the present invention can provide a Safety Integrity Level 4 (SIL-4) solution to an intrusion detection system (IDS) which will meet the railway requirements for fail-safe operation, especially as required in high-speed operation.

Aspects of the present invention provide a system and method of intrusion detection for an area. In an illustrative embodiment, the system detects intrusions and other disruptions in a railyard or similar location. The system may be generally described as comprising some set of intrusion detection sensors, associated computing systems, and communications systems to permit data recorded by the sensors to be analyzed for signals that indicate an intrusion, and to transmit an alert to a designated location that may or may not be itself part of the system.

In an illustrative embodiment, the method may be generally described as collecting data from the sensors, analyzing that data to determine if an intrusion has occurred, and transmitting an alert signal to an appropriate destination.

In a more particular illustrative embodiment, the system can comprise some number of intrusion detection sensor nodes which make use of more than one sensing modality to provide verification and/or refinement of intrusion detection; these sensing modalities may be visible light, infrared, microwaves, lidar, radar, acoustic, or any other means of sensing. Data from the multiple sensors can be fused (correlated and/or combined in appropriate fashions, as known to those skilled in the art) to provide higher certainties of detection and better rejections of false alarms.

An illustrative embodiment includes redundancy in sensing node and/or monitoring system designs, e.g., to reduce any chances of single-points-of-failure for the devices and systems. These sensing systems may be stationary, mounted to observe some portion of a railyard, or mobile, mounted upon various vehicles, to provide safety and/or security information to the vehicle and/or its operators.

Other aspects of the invention provide methods, systems, program products, and methods of using and generating each, which include and/or implement some or all of the actions described herein. The illustrative aspects of the invention are designed to solve one or more of the problems herein described and/or one or more other problems not discussed.

BRIEF DESCRIPTION OF THE DRAWINGS

These and other features of the disclosure will be more readily understood from the following detailed description of the various aspects of the invention taken in conjunction with the accompanying drawings that depict various aspects of the invention.

It is noted that the drawings may not be to scale. The drawings are intended to depict only typical aspects of the invention, and therefore should not be considered as limiting the scope of the invention. In the drawings, like numbering represents like elements between the drawings.

DETAILED DESCRIPTION

Figure 1:
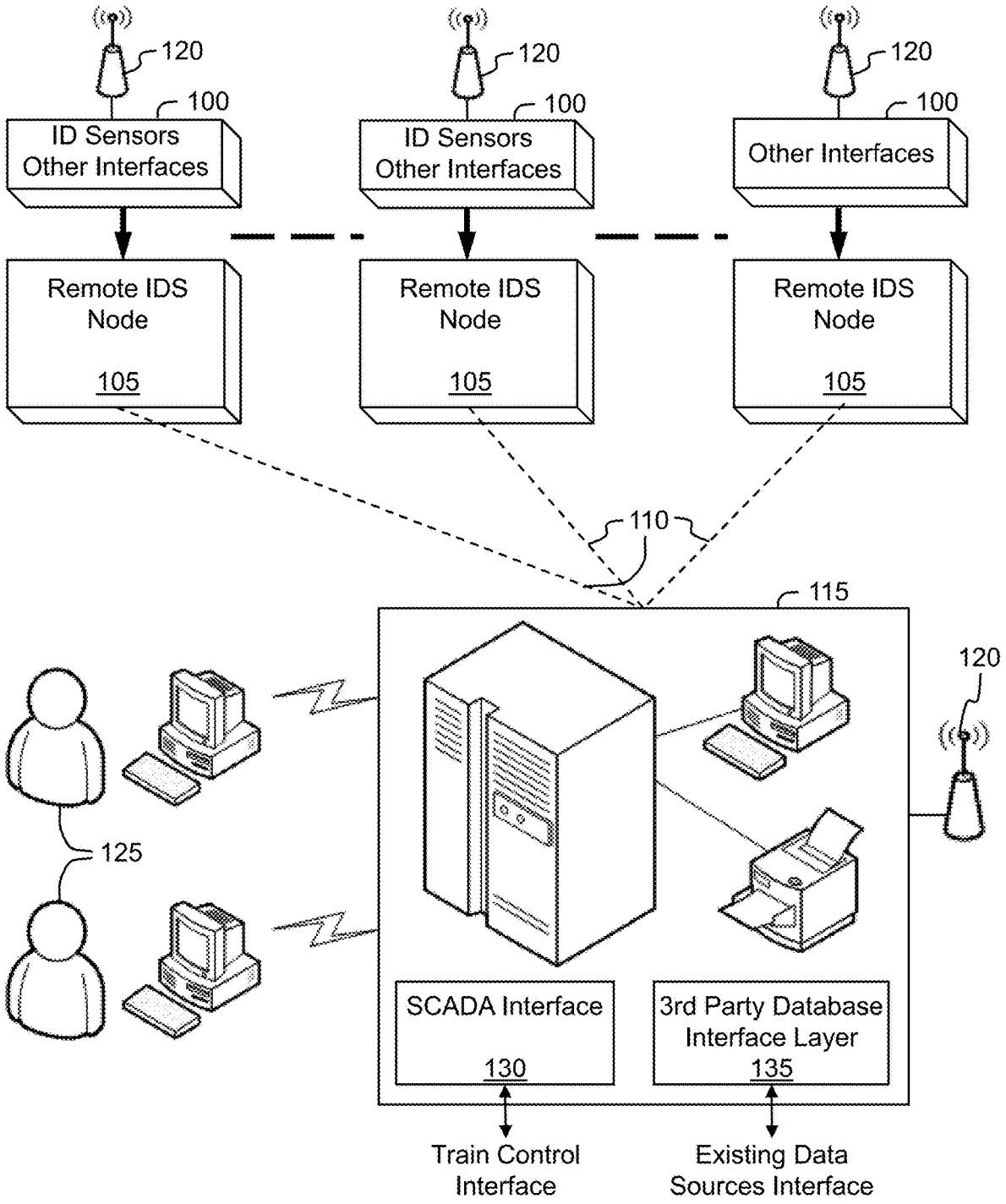
FIG. 1 shows a block diagram of an illustrative intrusion detection system architecture according to an embodiment.

FIG. 1 shows a block diagram of an illustrative intrusion detection system (IDS) architecture according to an embodiment. In this embodiment, the input comes from a variety of intrusion detection (ID) sensors 100, and is analyzed by remote IDS nodes 105. After signal conditioning and analysis, the resulting sensor data is sent via a primary communications link, such as a fiber optic backbone 110, to an intrusion detection monitoring node, such as a central base station 115.

The base station 115 can comprise a centralized location for multiple intrusion detection sensor nodes 105. The base station 115 can have both the visibility and computing power to combine and correlate measurements across a geographically dispersed sensor set. In an embodiment, the central base station 115 can include redundant servers. However, it is understood that this is only illustrative. For example, in other embodiments the base station 115 can comprise a portable computing device. Regardless, the base station 115 can include software to analyze the sensor data from at least one intrusion detection sensing node 105 to identify and characterize an intrusion detection event.

For redundancy, each Ethernet network node includes a cell/satellite backup communications link 120. The base station 115 can provide analysis results, instructions, and/or the sensor data to any remote users 125, a group which may include maintenance personnel or personnel monitoring for incidents. The base station 115 also can provide the analysis results, instructions, etc., machine-to-machine, e.g., in the form of a SCADA interface 130 directly to an external train control interface to a controller on a locomotive. For example, the base station 115 can provide an instruction to trigger a control action of a device. In particular, the device can be a vehicle (e.g., a locomotive, a maintenance of way vehicle, etc.), and the control action can control one or more aspects of the vehicle's function. A third party database interface layer 135 can provide further integration by obtaining additional data (e.g., remote sensing data, etc.) from existing data source(s) which may be fused with the data being provided by the remote IDS nodes 105 in order to generate the analysis results.

Figure 2:
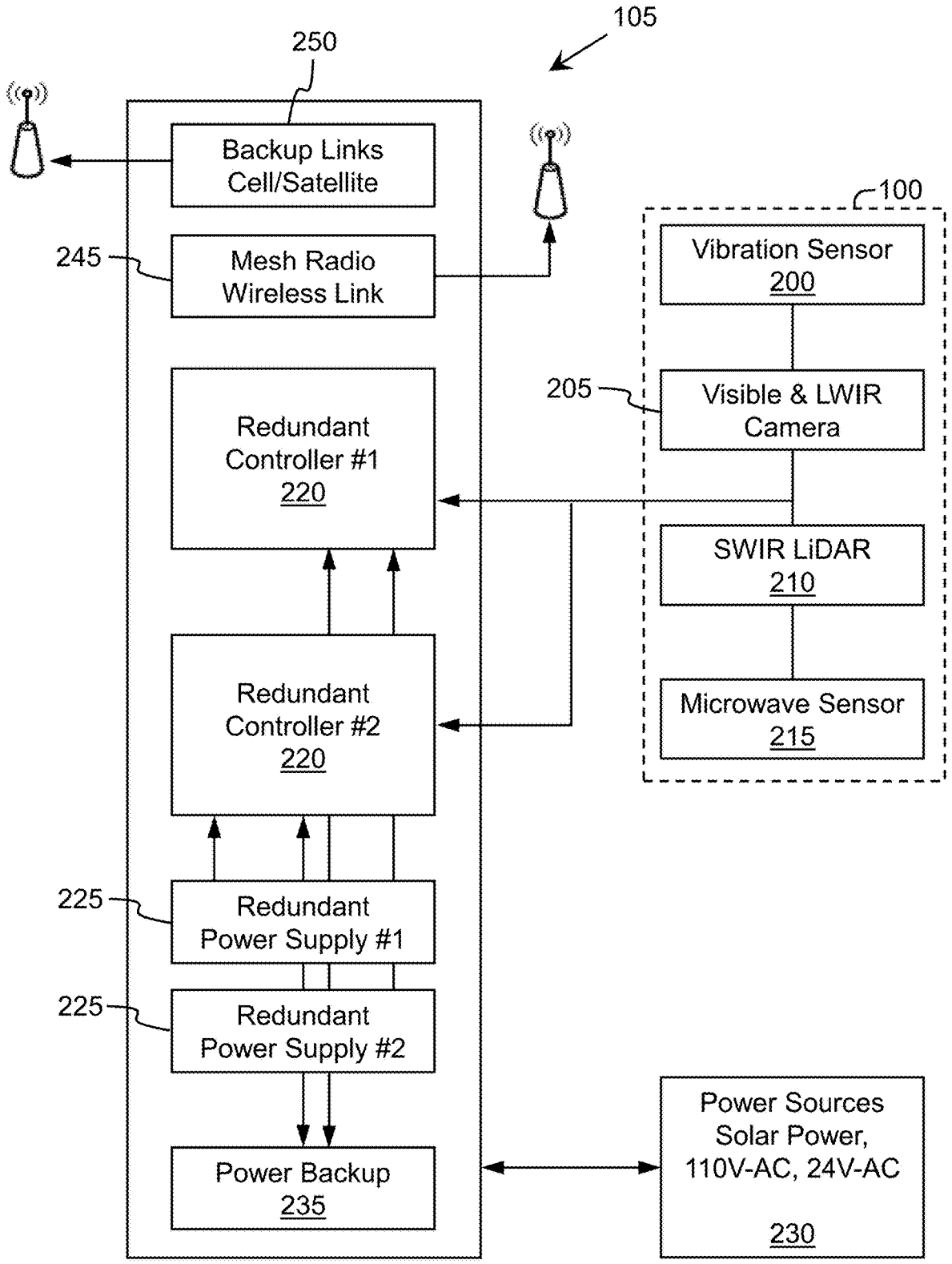
FIG. 2 shows a block diagram for an illustrative multi-sensor fusion-based remote activity monitoring node according to an embodiment.

FIG. 2 depicts one embodiment of a remote IDS node 105, in this case an intrusion (e.g., falling objects, vehicle, animal, people, etc.) activity monitoring node. The IDS node 105 can include a set of intrusion detection sensors 100 which includes sensors configured to acquire sensor data for multiple types of sensing modalities, such as vibration sensing, imaging, range detection, sound detection, etc. Embodiments of intrusion detection sensors 100 are depicted in the form of a vibration sensor 200, a visible and/or long wave infrared (LWIR) camera 205, a short wave infrared (SWIR) light detection and ranging (LIDAR) system 210, and a microwave radio detection and ranging (RADAR) sensor 215. Sensor signals captured by the intrusion detection sensors 100 can be delivered in parallel to two or more redundant controllers 220. The use of redundant controllers 220 provides for continued operation even if one controller fails.

Similarly, each controller 220 can be powered using two or more redundant power supplies 225, so that a failure of a single supply does not result in failure of the entire remote IDS node 105. The system power can be provided by one or more external power sources 230. These might include solar power, industrial 110 VAC, or vehicle 24 VAC, etc. In the event that the external power sources fail, a power backup system 235, such as a battery-powered Uninterruptible Power Source (UPS), can supply power until primary power is restored.

Figure 3:
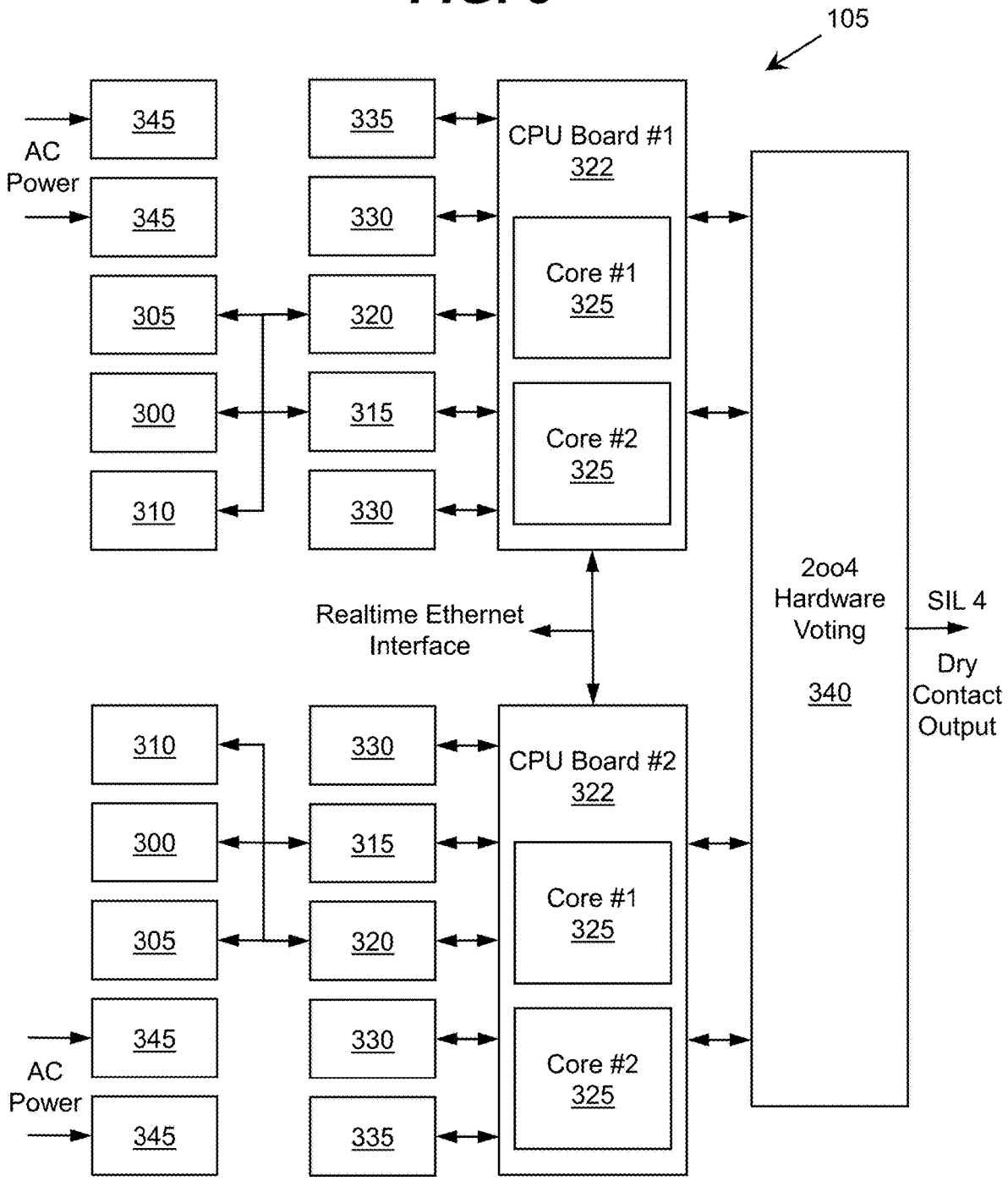
FIG. 3 shows a block diagram for an illustrative multi-spectral sensor fusion system according to an embodiment.

FIG. 3 depicts an embodiment of a multi-spectral sensor fusion IDS node 105. The sensing is provided by near infrared (NIR) LIDARs 300, NIR and IR cameras 305, and vibration sensors 310. While the drawing shows separate instances of the sensing devices 300, 305, 310 for each CPU board 322, it is understood that these are included for clarity. In particular, each CPU board 322 can receive redundant sensor data acquired by the same sensing devices 300, 305, 310. The signals are provided to NIR LIDAR interfaces 315 and camera and sensor interfaces 320. After signal conditioning and initial analysis by the corresponding interfaces 315, 320, the results are provided to a CPU board 322, which can include redundant CPU cores 325 for fusion processing. The redundant CPU cores 325 can execute the analysis algorithms in parallel, to allow verification by comparing the results; the CPU pairs on separate boards allows the system to continue operating in the event that one pair fails.

The sensor interfaces 315 and 320 are monitored using interface diagnostics modules 330; sensor malfunctions detected by the diagnostics modules 330 are reported to the CPU cores 325. Watchdog modules 335 can monitor the function of the CPU cores 325. The CPU cores 325 are required to notify the watchdog modules 335 with a reset operation on a particular temporal schedule; if the CPU cores 325 fail to notify the watchdog modules properly, a malfunction is adjudged, and the CPU cores 325 are restarted.

The results of the analysis by CPU cores 325 are presented to a voting module 340, such as a 2oo4 hardware voting configuration, where the results are compared; if the results from redundant sensors are not the same, the voting module 340 judges a failure, accepting either a unanimous or majority vote, or rejecting all of the results, depending on the SIL level. The system can be powered by redundant power supplies 345, providing for continued system operation even if one of the power supplies 345 fails.

Figure 4:
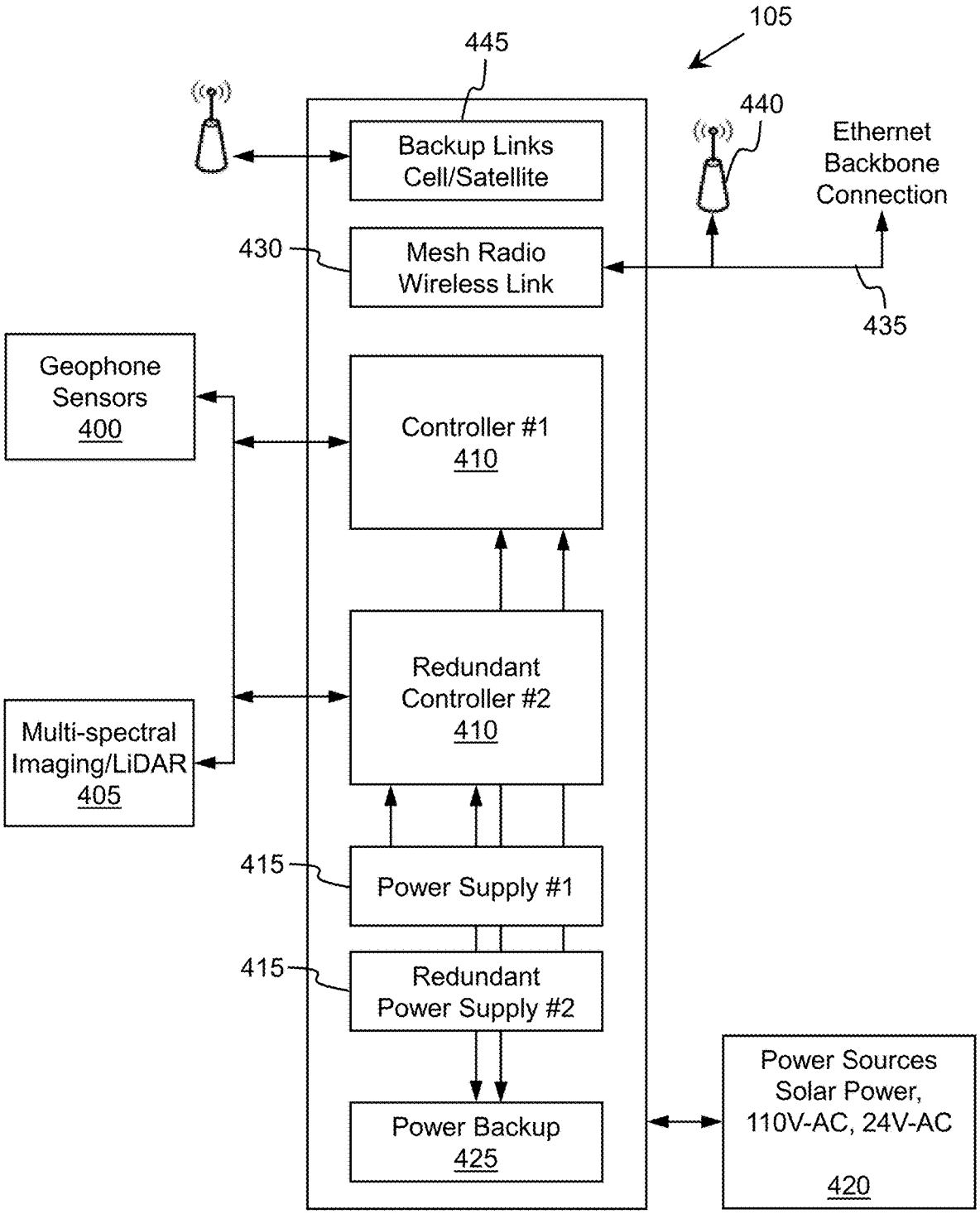
FIG. 4 shows a block diagram of an illustrative track intrusion detection remote monitoring node according to an embodiment.

FIG. 4 shows in greater detail an illustrative remote monitoring IDS node 105 for track intrusion detection with ground vibration sensors 400, e.g., based on geophones, as well as visual sensing 405 using multi-spectral imaging, optionally fused with LIDAR, according to an embodiment. In particular, the IDS node 105 can detect an intrusion using vibration detection coupled with multi-spectral object detection. This allows detection of dynamic intrusions as objects actively enter the restricted space, as well as static intrusions, once the objects come to rest. The data from the sensors 400, 405 can be supplied to redundant controllers 410 for analysis and forwarding; the redundancy provides for continued operation even if one controller fails. Moreover the controllers 410 can be powered using redundant power supplies 415; the redundancy provides for continued operation even if one supply fails.

The overall system power can be supplied by external sources 420, which may include solar, power-line 110/220 VAC, or low-voltage 24 VAC. In the event that the external power source 420 fails, the system can contain a backup power module 425 which functions as an uninterruptible power source.

Communication with the base station 115 can be provided by a communication link module 430. In a preferred embodiment the communication link module 430 utilizes a high-bandwidth Ethernet backbone link 435. In an alternate embodiment where a wired link is not feasible, it may use a mesh radio wireless link 440, which provides less data bandwidth but can reach past some physical impediments. In the event that the primary link fails, a backup link 445 can be provided utilizing cellular or satellite wireless links, which have limited bandwidth but still provide some communication capabilities.

Figure 5:
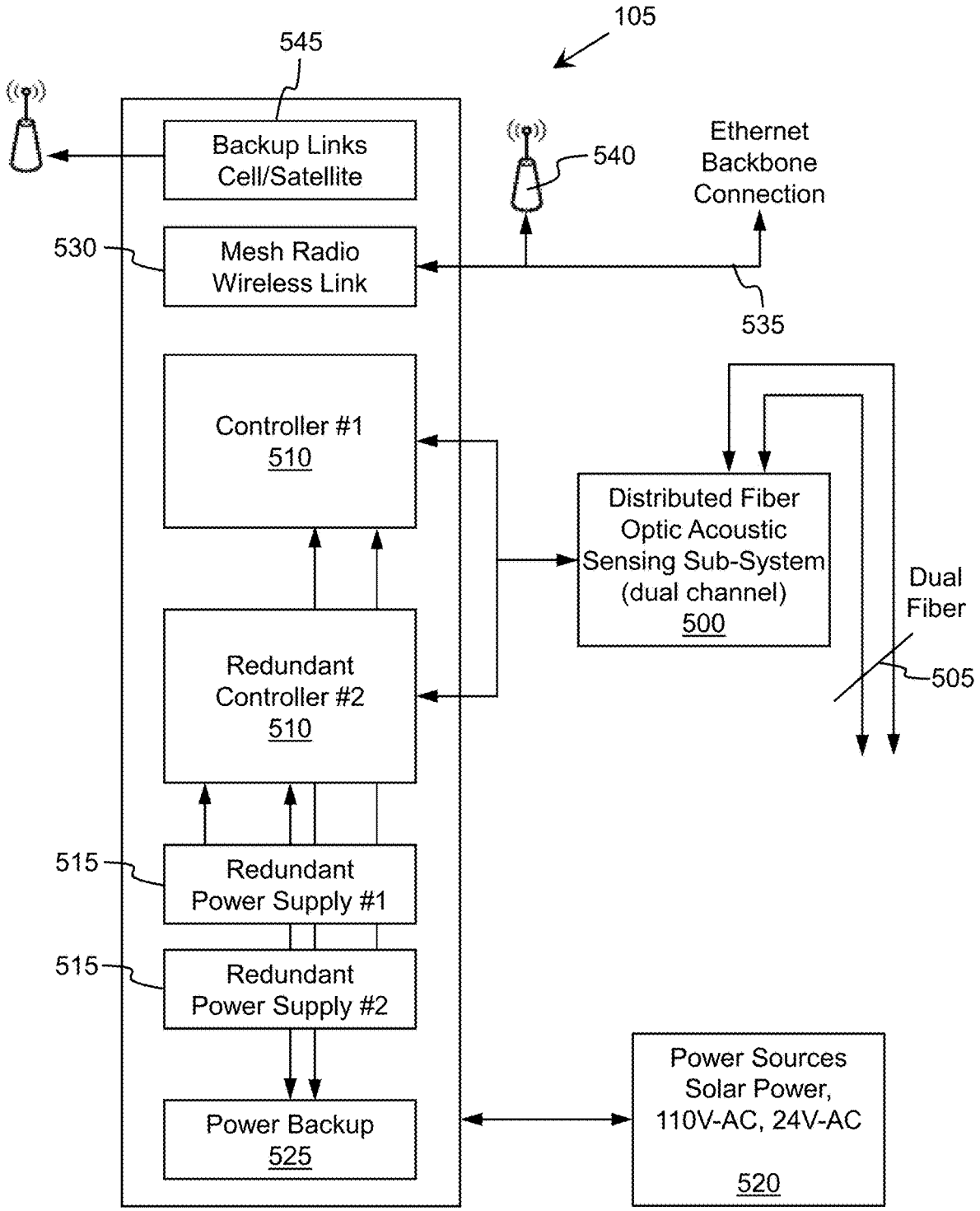
FIG. 5 shows a block diagram of an illustrative fiber-optic distributed acoustic sensing based remote activity monitoring node according to an embodiment.

FIG. 5 shows another remote monitoring IDS node 105 which detects acoustic signals from dynamic intrusion events using, for example, a distributed fiber optic acoustic sensing sub-system 500 using either a short or a long fiber. Dual fibers 505 provide redundancy in the event one of them fails. The signals can be sent to redundant controllers 510 for signal conditioning and forwarding; the redundancy provides for continued operation even if one controller fails.

Moreover the controllers can be powered using redundant power supplies 515; the redundancy provides for continued operation even if one supply fails. The overall system power can be supplied by external sources 520, which may include solar, power-line 110/220 VAC, or low-voltage 24 VAC, etc. In the event that the external power source 520 fails, the system can contain a backup power module 525 which functions as an uninterruptible power source.

Communication with the base station 115 can be provided by a communication link module 530. In an embodiment the communication link module 530 utilizes a high-bandwidth Ethernet backbone link 535. In an alternate embodiment where a wired link is not feasible, it may use a mesh radio wireless link 540, which provides less data bandwidth but can reach past some physical impediments. In the event that the primary link fails, a backup link 545 can be provided utilizing cellular or satellite wireless links, which have limited bandwidth but still provide some communication capabilities.

Figure 6:
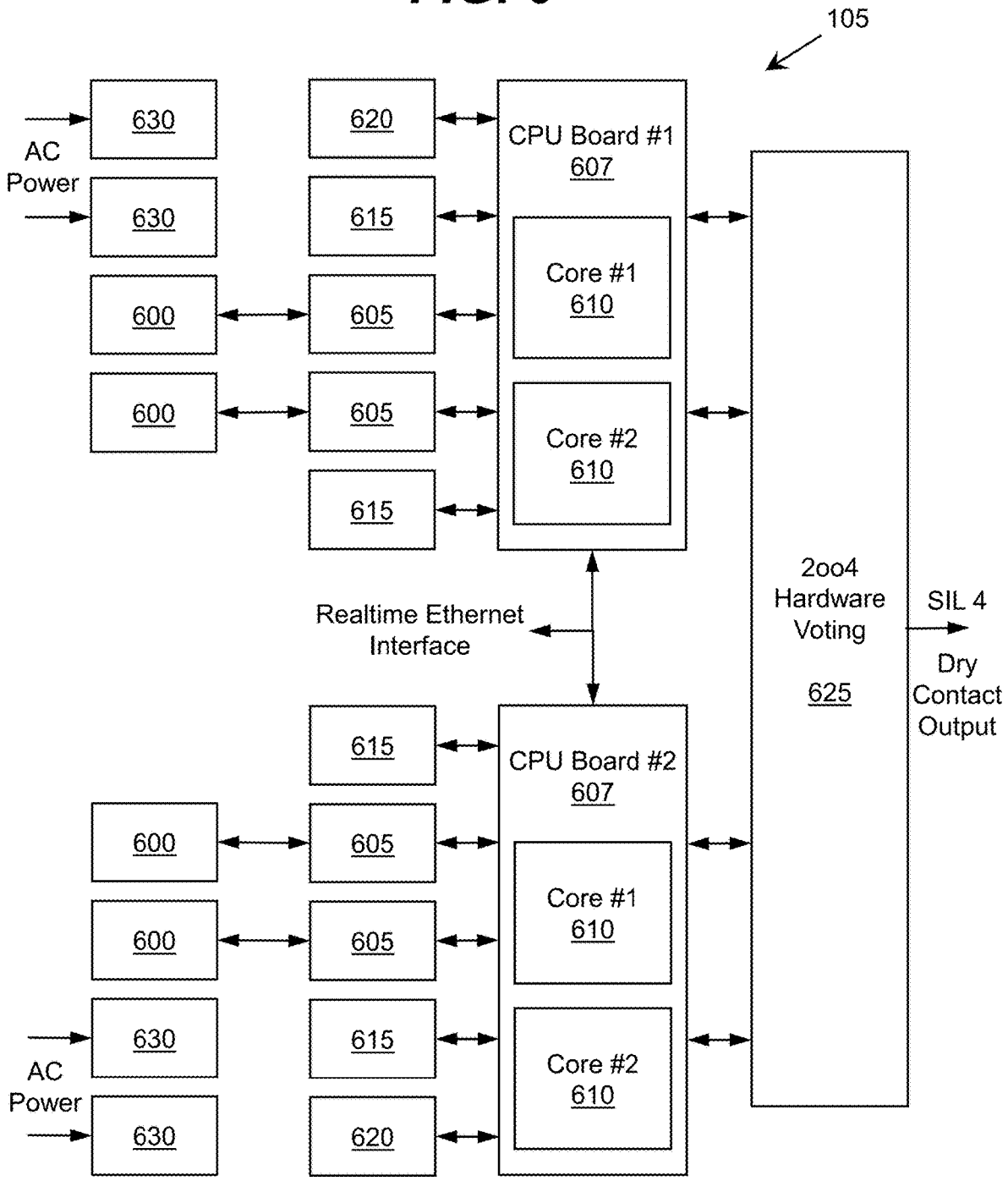
FIG. 6 shows a block diagram of an illustrative SIL-4 compliant vibration monitoring node according to an embodiment.

FIG. 6 shows another remote monitoring IDS node 105 which detects vibration using vibration sensors 600. The signals from the sensors 600 are provided to sensor interfaces 605 which provide signal conditioning and, in some embodiments, analog to digital conversion. While the drawing shows separate instances of the vibration sensors 600 for each CPU board 607, it is understood that these are included for clarity. In particular, each CPU board 607 can receive redundant sensor data acquired by the same vibration sensors 600. The resulting sensor data can be provided to CPU boards 607, each of which can comprise multi-core CPUs 610. The use of multiple cores provides redundancy, so that the system can continue to function even if one core fails.

Each sensor interface 605 has an accompanying interface diagnostic module 615 which can check for proper function; each diagnostic module provides its observations to the CPUs 610 so that the CPUs can judge the validity of the relevant sensor data. The CPUs are also monitored using watchdog modules 620, which must be serviced according to a schedule; if the CPUs 610 do not meet the schedule required by the watchdog modules 620, the watchdog modules have the ability to reset or shut down one or more of the CPUs.

The results of analysis from the CPUs 610 can be delivered to a hardware voting module 625, which judges the validity of the results based on agreement between the results delivered by the multiple CPUs 610; if there is agreement per a 2oo4 criterion, the results are considered valid. Each CPU 610 can be powered using redundant power supplies 630; this allows the node to continue to operate even if one of the power supplies fails.

Figure 7A:
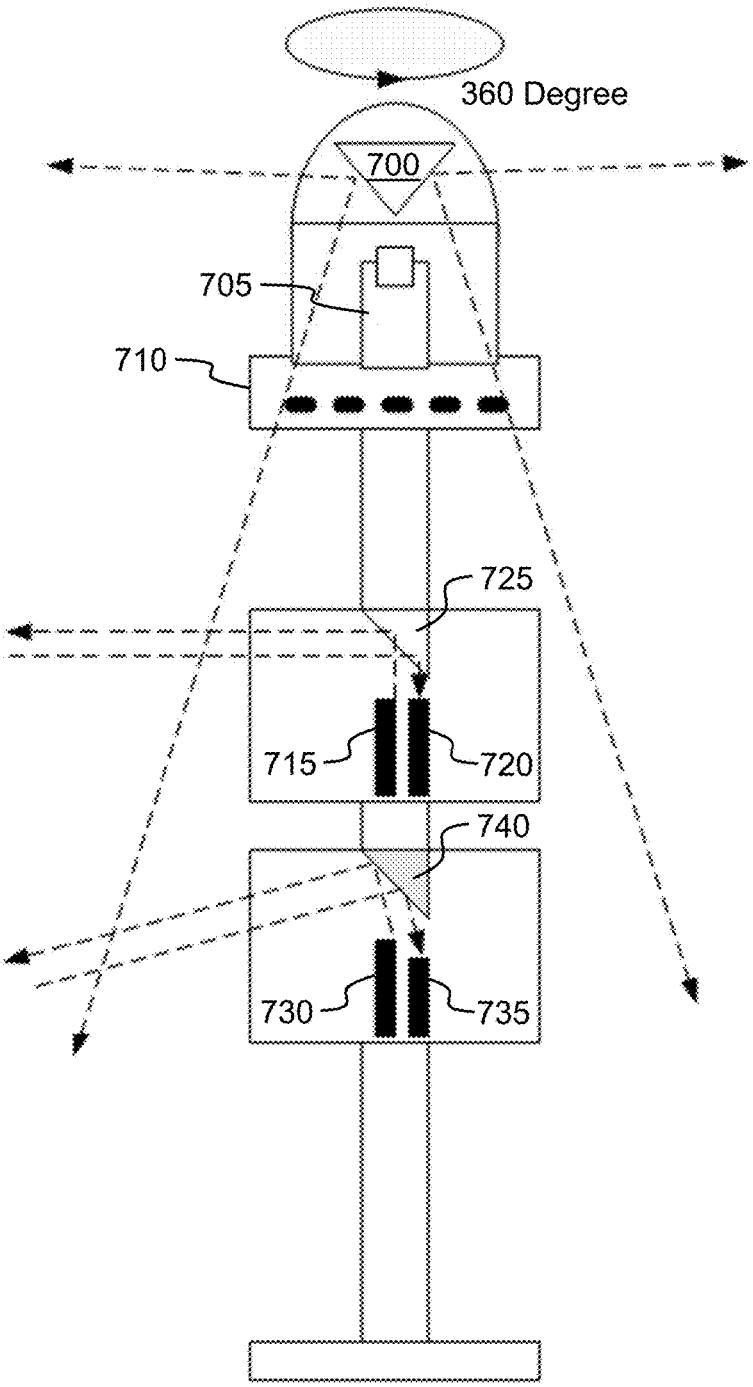
FIGS. 7A and 7B show diagrams of illustrative embodiments of the intrusion detection system monitoring module.

FIG. 7A depicts the components of an illustrative image-based proximity detection IDS node. In the top portion, a panorama can be provided by a reflector 700 which focuses a wide field of view onto a camera 705, which could use visible light, near-IR, or short-wave IR, etc. The reflector 700 can be circular in top view and its cross-section may be conical, parabolic, or hyperbolic, providing a 360° view in azimuth and 180° view downward in elevation, subject only to occlusion by its own mounting. In the view of the camera 705, distance from the center of its image denotes horizontal distance from the center of the unit. To aid in nighttime monitoring, an embodiment could include an array of illuminators 710, appropriate to the camera technology.

For long-range presence detection, a laser 715 and photoreceptor 720 can be used in combination to perform range measurement to obstacles using, for example, a time of flight method. By reflecting through a rotating mirror 725, a 360° plane may be scanned for obstacles. For shorter-range presence detection, a similar time of flight method can employ laser 730 and photoreceptor 735, but in this case the mirror 740 not only can rotate to provide 360° scanning in azimuth, it also can change angle dynamically to provide a large field of view in elevation.

Figure 7B:
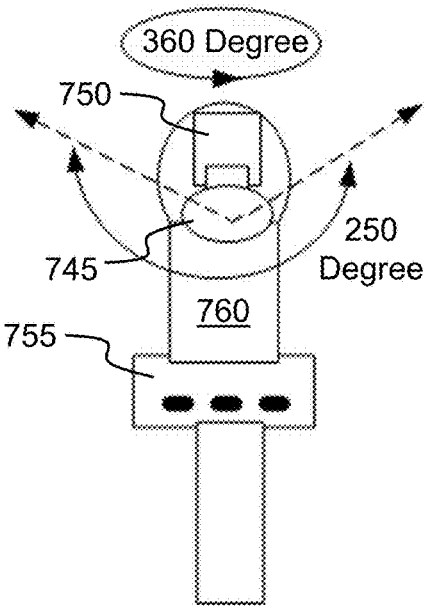

FIG. 7B depicts an alternate embodiment in which a wide-angle fish-eye lens 745 is mounted to a camera 750 oriented downward. As needed a ring of illuminators 755 with wavelength appropriate to the camera 750 can aid in low-light conditions. The lens 745 has a 360° azimuth field of view, and is chosen to have a very wide elevation field of view—for example, 250°—so that it can detect objects at levels from above the assembly down to ground level, with the exception of the portion of the field of view which is blocked by the mounting 760.

Figure 8A:
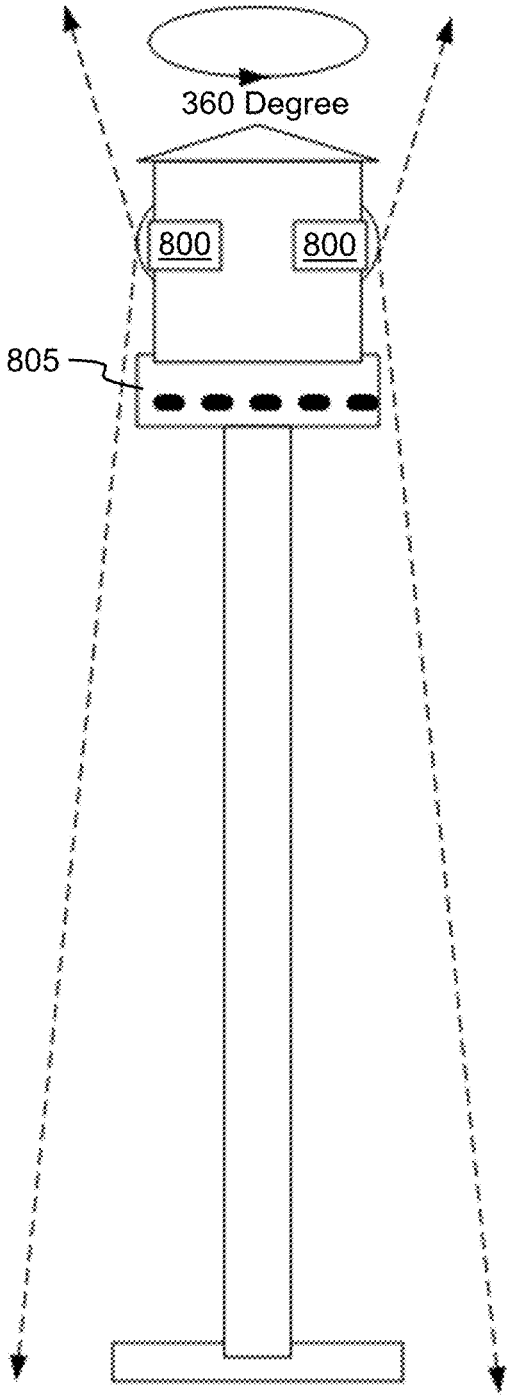
FIGS. 8A-8C show diagrams of an illustrative first alternate embodiment of the intrusion detection system.
Figure 8B:
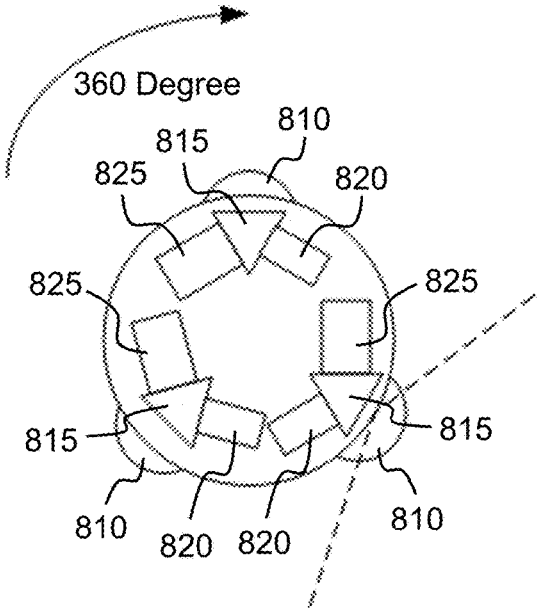
Figure 8C:
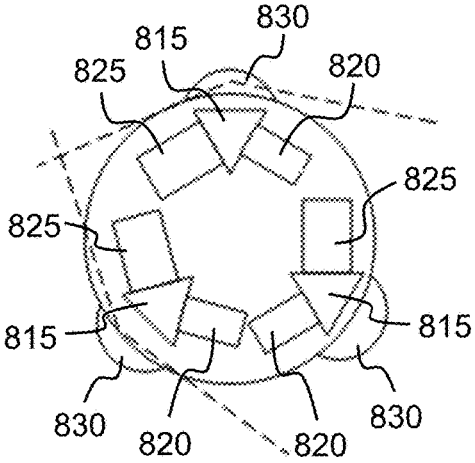

FIG. 8A depicts an illustrative alternate embodiment for the multi-spectral IDS node, in which local imaging is provided using wide angle lenses 800 which can have a combined azimuth coverage of 360°, supported as needed by a ring of illuminators 805 appropriate to the imaging technology (e.g., visible, NIR, or SWIR). FIG. 8B provides a top view of one possible imaging embodiment, in which each wide-angle lens 810 captures an image via a prism 815, which splits the light by wavelength to provide a visible light camera 820 and an IR camera 825. FIG. 8C depicts a further enhancement to FIG. 8B where wide-angle lenses 810 are replaced with fish-eye lenses 830, also with 360° azimuth but greater than 180° elevation angle. In this case, the lens fields of view overlap, allowing for software for "stitching" images or 3-D stereo imaging.

Figure 9A:
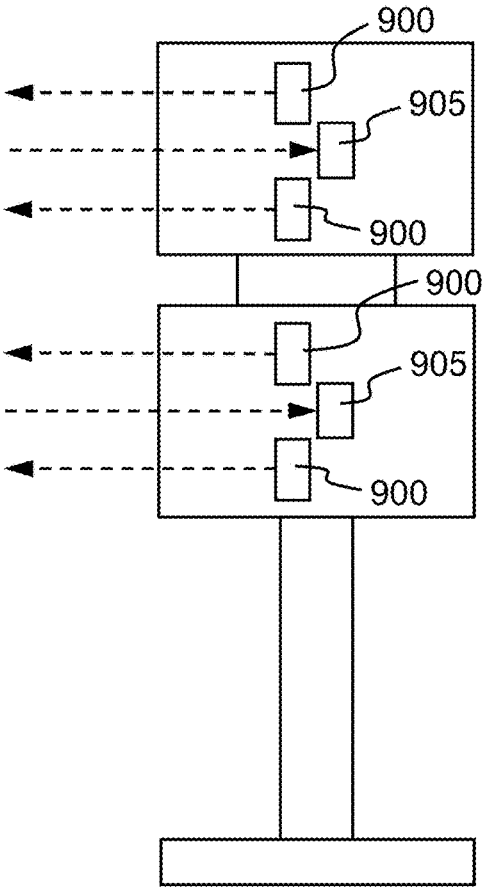
FIGS. 9A and 9B show diagrams of illustrative second alternate embodiments of the intrusion detection system.

FIG. 9A depicts an illustrative alternate embodiment in which a scanning time of flight distance sensor is replaced with a flash LiDAR, wherein illumination elements 900 engage for a short time to illuminate the entire field of view, and reflections are captured by photodetector arrays 905 for Time of Flight and Angle of Incidence analysis; these measurements may be used to compute distance by azimuth and elevation over the entire field of view.

Figure 9B:
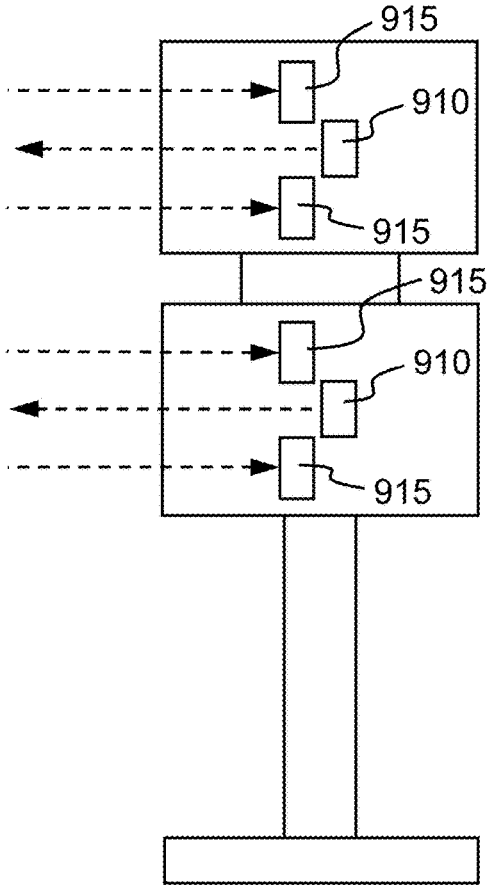

FIG. 9B depicts an illustrative alternate embodiment in which the distance sensor is implemented using a stereo vision technique. Illuminators 910 generate a signal which is reflected by objects in the field of view, and the reflections are captured by imagers 915 located at a small offset from one another. By analyzing the differences between images captured by a pair of imagers 915, distance to points in the field of view may be imputed.

Figure 10:
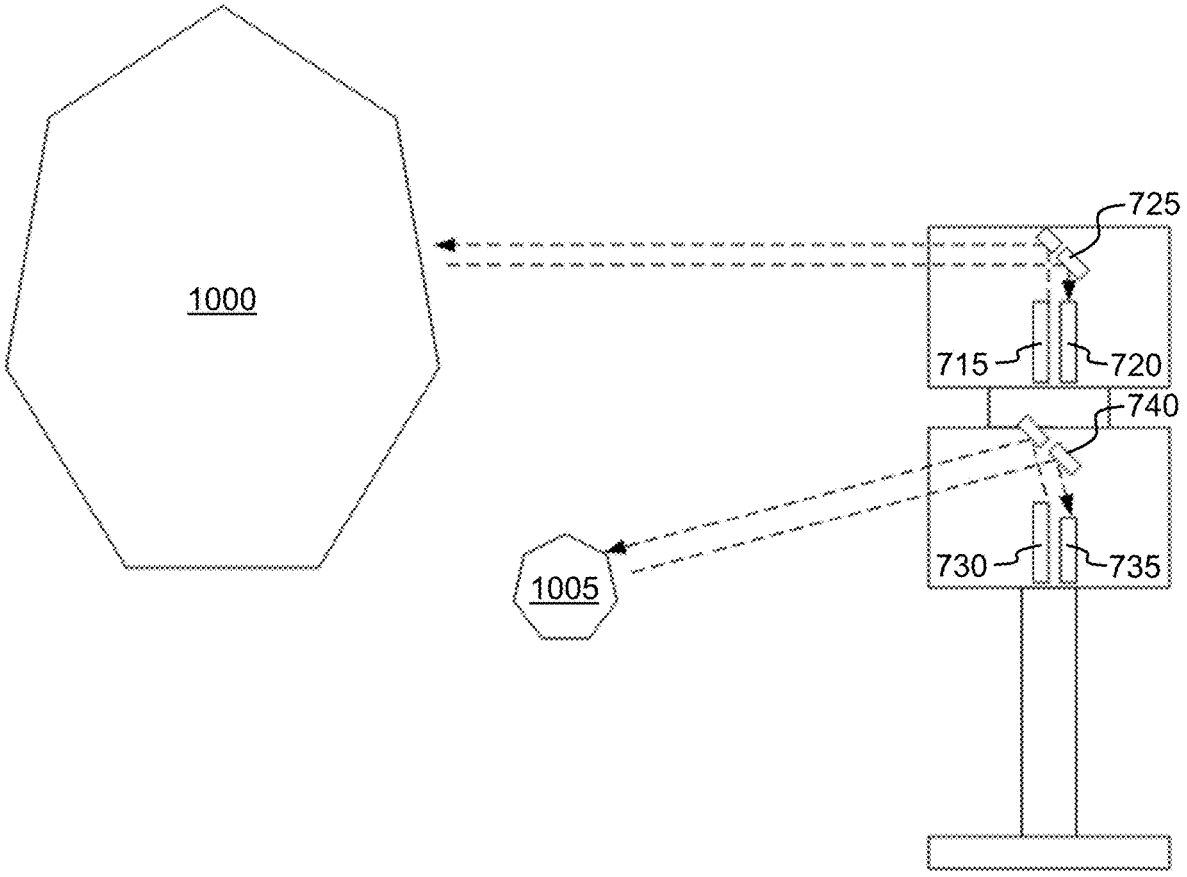
FIG. 10 illustrates an ability of the system to detect large or small objects according to an embodiment.

FIG. 10 depicts an enhanced usage of long-range optical scanner 715, 720, 725 along with short-range scanner 730, 735, 740. The long-range scanner 715, 720, 725, can operate at a high rotation speed, and can detect the presence of a large, distant object 1000; by altering the mirror angle and the rotation pattern, the same long-range optical scanner is capable of focusing on the detected object to provide more detail. Similarly the short-range scanner 730, 735, 740 is capable of providing detail on a smaller, nearby object 1005.

Figure 11A:
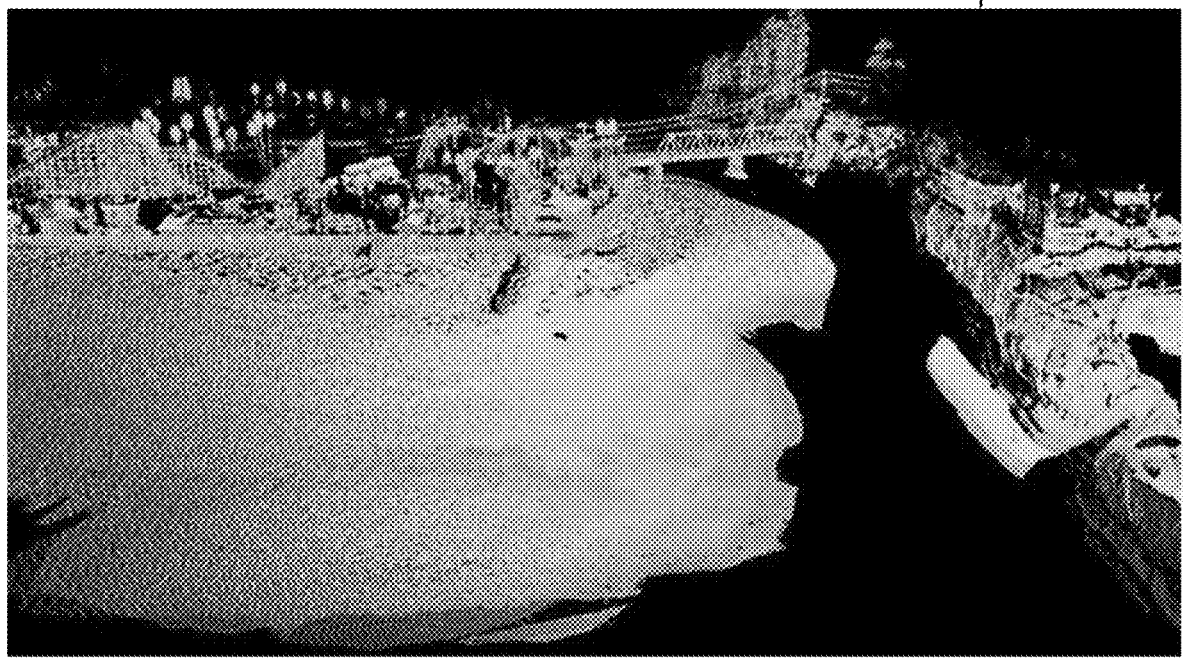
FIGS. 11A and 11B illustrate some of the benefits of image fusion approaches according to embodiments.
Figure 11B:
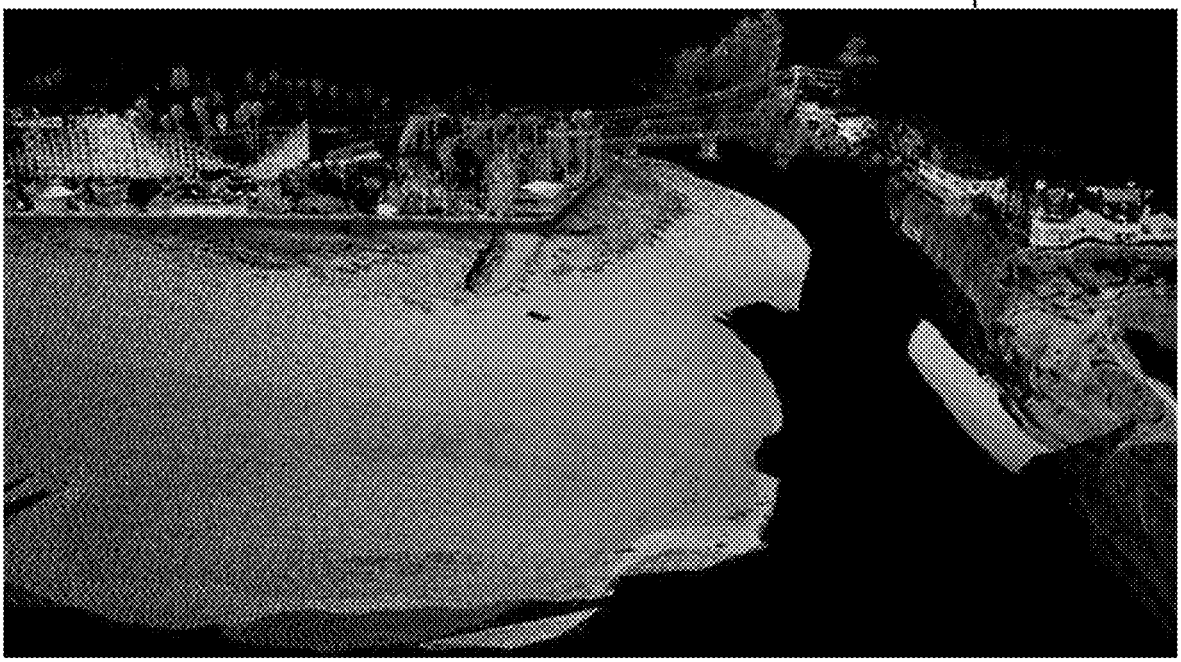

FIGS. 11A and 11B depict the value of fusing an image with depth information with a visible-light image according to an embodiment. Depth image 1100 shown in FIG. 11A can include point cloud data, which provides only depth data. The image 1100 contains the features of the image, and is colorized to denote the distance, but since depth is the significant datum, there are no color cues, only shape cues to recognize form details. Fused image 1105 shown in FIG. 11B can include point cloud data fused with image details. The fused image 1105 overlays the depth image 1100 with a visible-light image, providing natural colors to allow recognizing details.

Figure 12:
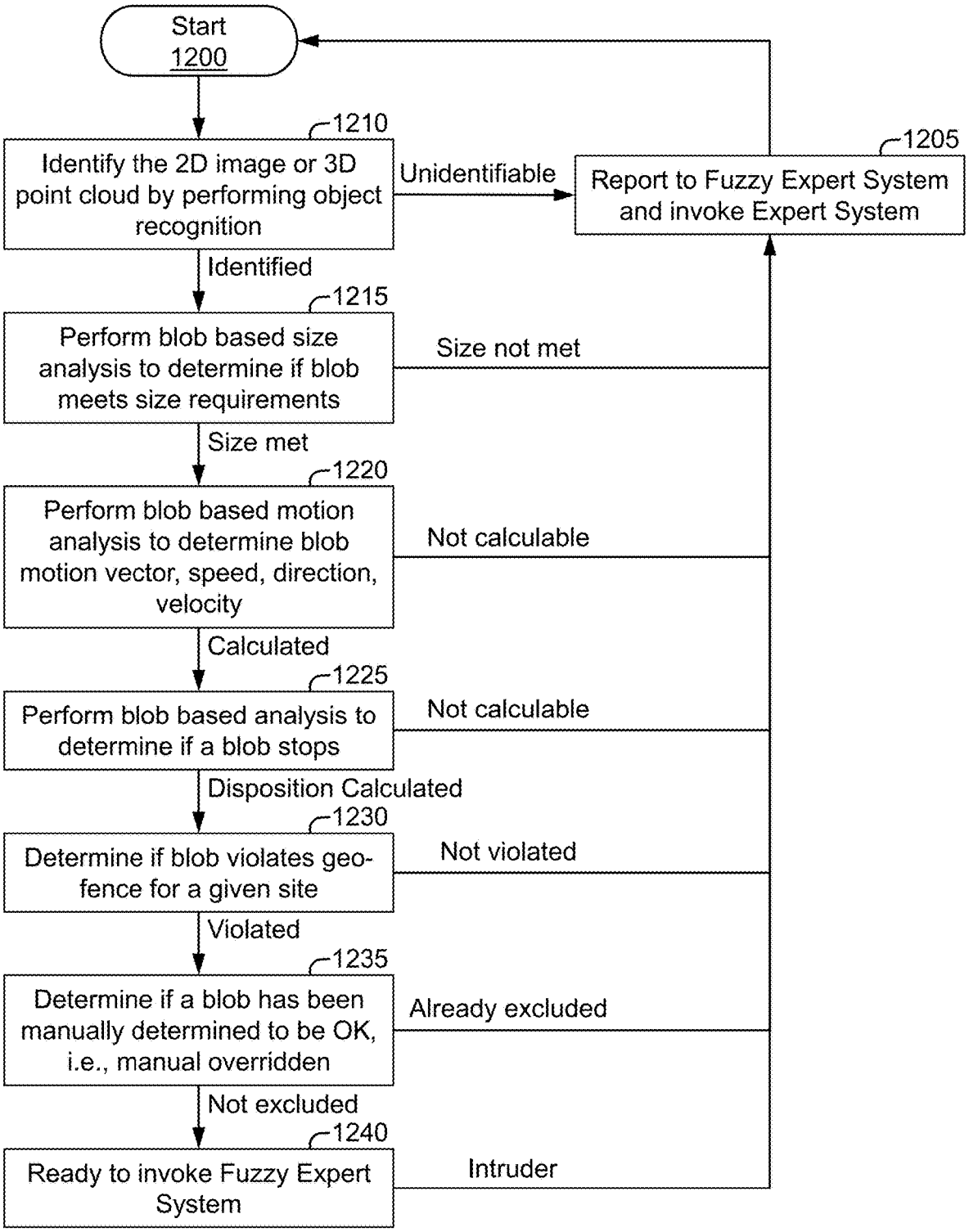
FIG. 12 illustrates a process of blob analysis for optical data according to an embodiment.

FIG. 12 shows a flow chart of a procedure to classify the properties of an intruding object based on a point cloud, e.g., as the first step in intrusion analysis, according to an embodiment. In an embodiment, the procedure is performed by an IDS node described herein. Each analysis sequence starts at the start step 1200, in which the sensor data arrives. Once the analysis is complete, the results, positive or negative, are provided to the fuzzy expert system which is invoked, in step 1205, and the procedure returns to the start step 1200.

The first step 1210 uses object recognition to identify the object based on the 2D image or 3D point cloud; if it cannot be identified the analysis completes with a negative result (e.g., unidentifiable) provided to the fuzzy expert system. Otherwise, processing can continue in order to determine spatial and/or temporal object properties for the detected blob. For example, in step 1215, the identified object undergoes a blob-based size analysis to determine whether the blob's size is within the size requirements of intrusion criteria; if it is not within the criteria the analysis completes with a negative result (e.g., size not met) provided to the fuzzy expert system.

The identified and sized object then undergoes motion analysis in step 1220 to determine its speed and direction; if these can't be determined the analysis completes with a negative result (e.g., not calculable) provided to the fuzzy expert system. The object's motion is then analyzed in step 1225 to determine whether the blob has come to rest. If this cannot be determined, the analysis completes with a negative result (e.g., not calculable) provided to the fuzzy expert system.

Next, the object properties can be evaluated with respect to intrusion criteria. For example, the object's location can be analyzed in step 1230 to determine whether the blob is within a geo-fence defining at least one intrusion zone; if the blob is not in any intrusion zone the analysis completes with a negative result (e.g., not violated) provided to the fuzzy expert system. Although the object has been identified as an intruder, it may be one which has manually been identified by personnel as a non-intruder; this is checked against an override list in step 1235; if the blob has been identified as a non-intruder the analysis completes with a negative result (e.g., already excluded) provided to the fuzzy expert system. At this point the object has been identified as a true intruder, so relevant data for the fuzzy expert system is gathered in step 1240 and the analysis completes with a positive result (e.g., intruder) provided to the fuzzy expert system.

Figure 13:
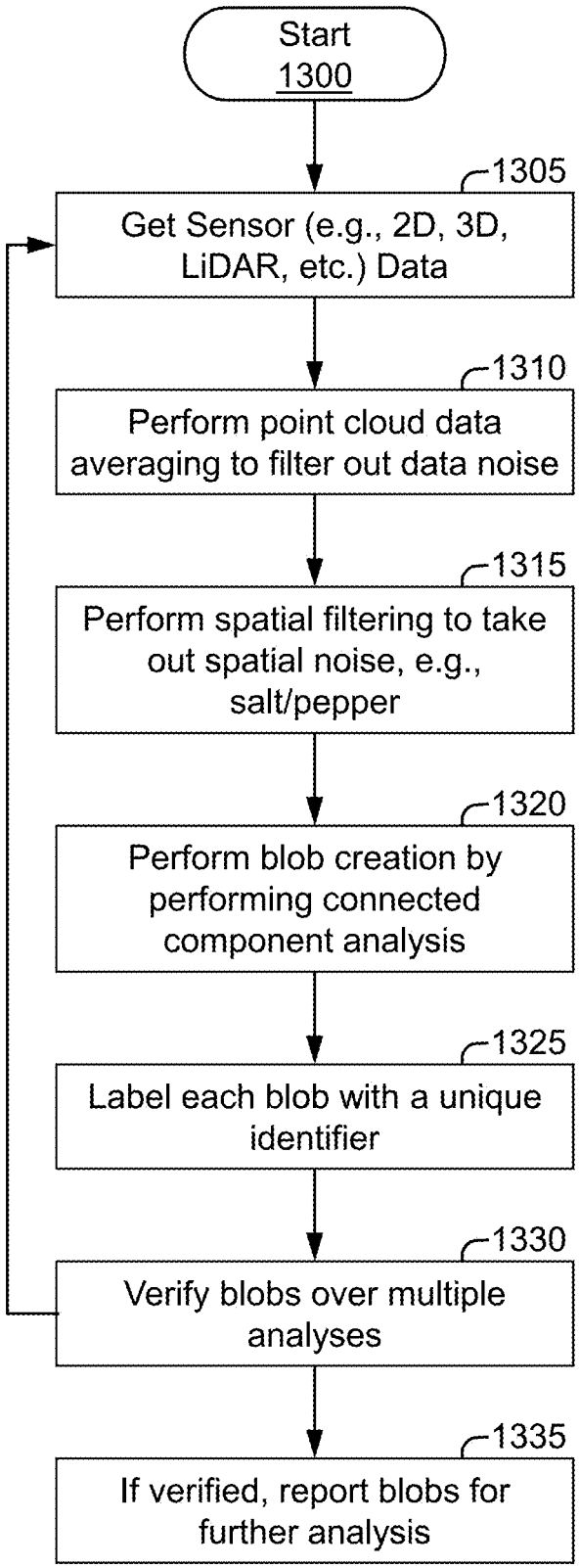
FIG. 13 shows a flowchart for sensor data analysis according to an embodiment.

FIG. 13 depicts a flowchart with additional details regarding the object recognition step 1210 according to an embodiment, which can be performed by an IDS node described herein. The procedure starts by gathering sensor data in step 1305, which could include 2D, 3D, and/or LIDAR data. In step 1310, data averaging is performed to remove data noise from the sensor data. Next, in step 1315, spatial averaging is performed to remove spatial noise from the filtered data.

In step 1320, the de-noised data is partitioned into blobs, which are groups of points with common attributes, implying potential connectedness, which are thus candidates as objects. Each blob, e.g., candidate object, is labeled in step 1325 with a unique identifier so that it can be tracked through the processing. Since a blob is only a candidate object, it may be ephemeral or illusory (noise); to exclude this possibility, a blob must be verified in step 1330 to appear in multiple consecutive analyses to be considered authentic. If the blob has not met these criteria yet, the process returns to fetch new sensor data in step 1305. If the blob has met these criteria, the blob is reported in step 1335 to the classifier for further analysis.

Figure 14:
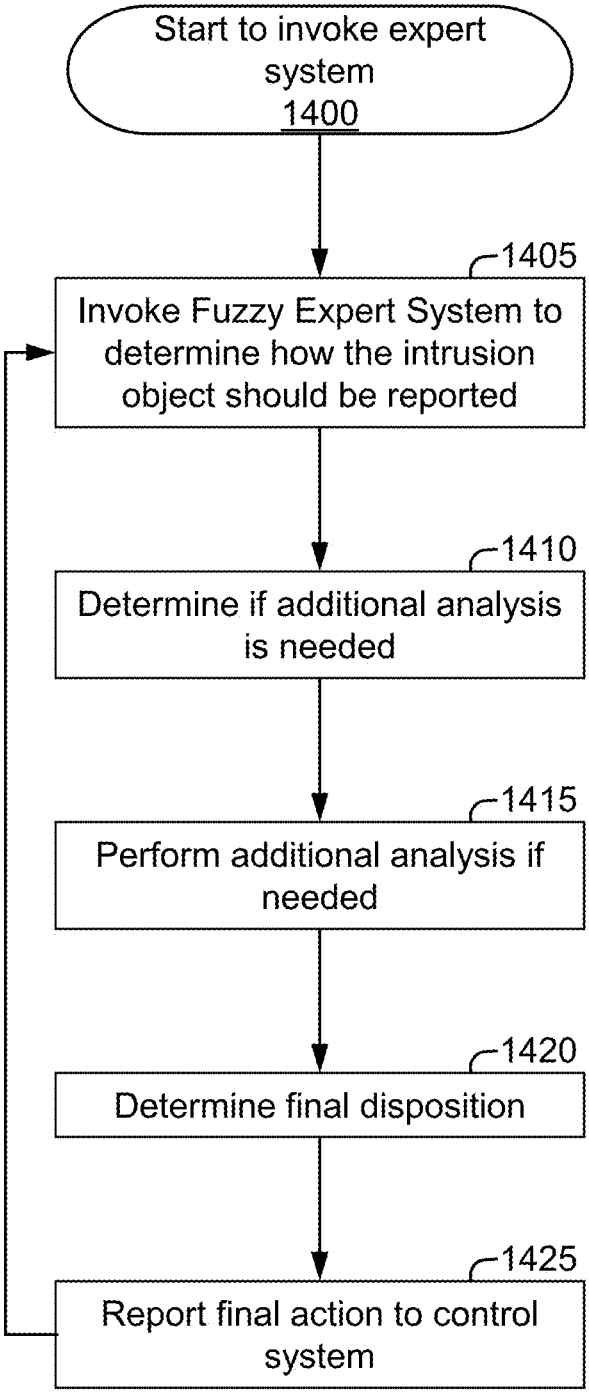
FIG. 14 shows a data analysis flowchart incorporating an expert system according to an embodiment.

FIG. 14 depicts a flowchart for the expert system according to an embodiment, which can be implemented on an IDS node and/or the central base station 115 described herein. The expert system is started up in step 1400. In step 1405 the expert system intrusion decision tree is executed to determine the proper reporting of the intruding object. In step 1410, the results are analyzed to determine whether further analysis is required; if so, other decision trees are used to perform additional analysis in step 1415. Once all analysis is complete, in step 1420, a determination is made as to the final disposition. In step 1425, the results of the expert system analysis are reported to the central base station 115 (e.g., a control system) and the procedure restarts at step 1400.

Figure 15:
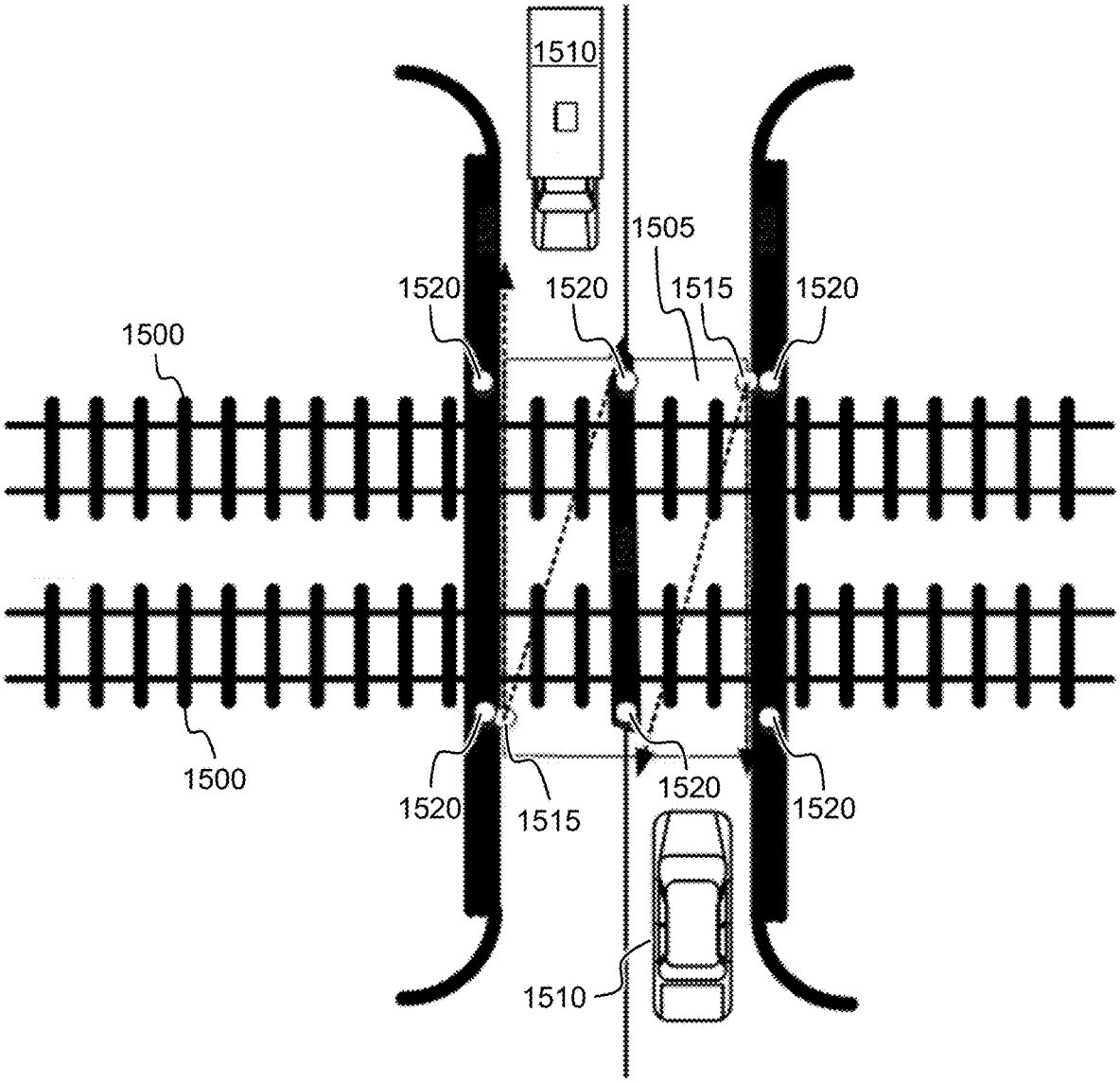
FIG. 15 illustrates a top elevation view of an embodiment of the system at a railway overpass.

FIG. 15 depicts intrusion detection at a railway overpass, where railroad tracks 1500 traverse over a bridge structure 1505 with vehicular traffic 1510 underneath, according to an embodiment. A particular hazard in this scenario is a collision by a vehicle with the bridge structure 1505. In this embodiment, two surveillance cameras 1515 are placed so as to view oncoming traffic in each direction under the bridge. Additionally, multiple accelerometers 1520 are installed at critical locations in the bridge structure 1505, which are capable of sensing impacts. An IDS node described herein can use the detected impacts to trigger the surveillance cameras 1515 so that image sequences can be captured depicting the history of the impact and/or any visible damage to the bridge structure.

Figure 16:
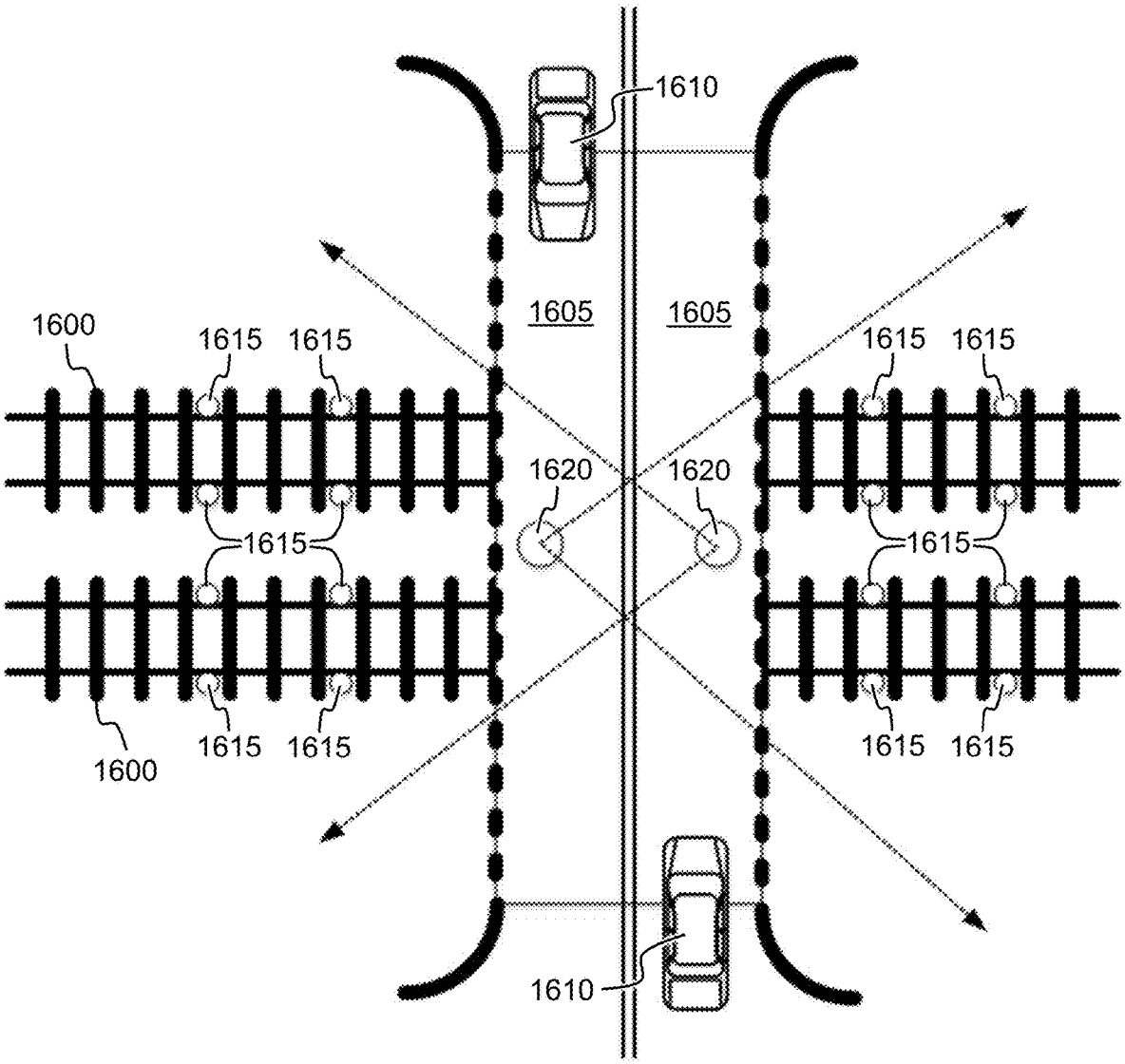
FIG. 16 illustrates a top elevation view of an embodiment of the system at a railway underpass.

FIG. 16 depicts an IDS node installation at an overpass, where the rails 1600 pass underneath a fenced road surface 1605, with vehicular traffic 1610 passing over the rails 1600. In an underpass as shown in FIG. 15, the primary hazard is vehicular impacts which damage the rail bridge structure, but in an overpass, such as that shown in FIG. 16, the primary hazard is objects which fall from the vehicular bridge onto the tracks 1600.

The track area in the vicinity of the overpass is monitored by geophones 1615, which are capable of sensing minute tremors in the earth resulting from a falling object; multiple geophones 1615 can be laid out in an array, which allows the IDS node to identify the location of the impact. Multi-spectral imaging systems 1620 can be located underneath the overpass (e.g., mounted to an underside of the overpass, on the ground, on a support structure for the overpass, and/or the like) which are capable of visibly identifying objects which have fallen on the tracks. A multi-spectral imaging system might include visible light, near-IR, short-wave IR, and/or LIDAR, with the signals from different imagers fused to provide a multi-spectral view of any object.

Figure 17:
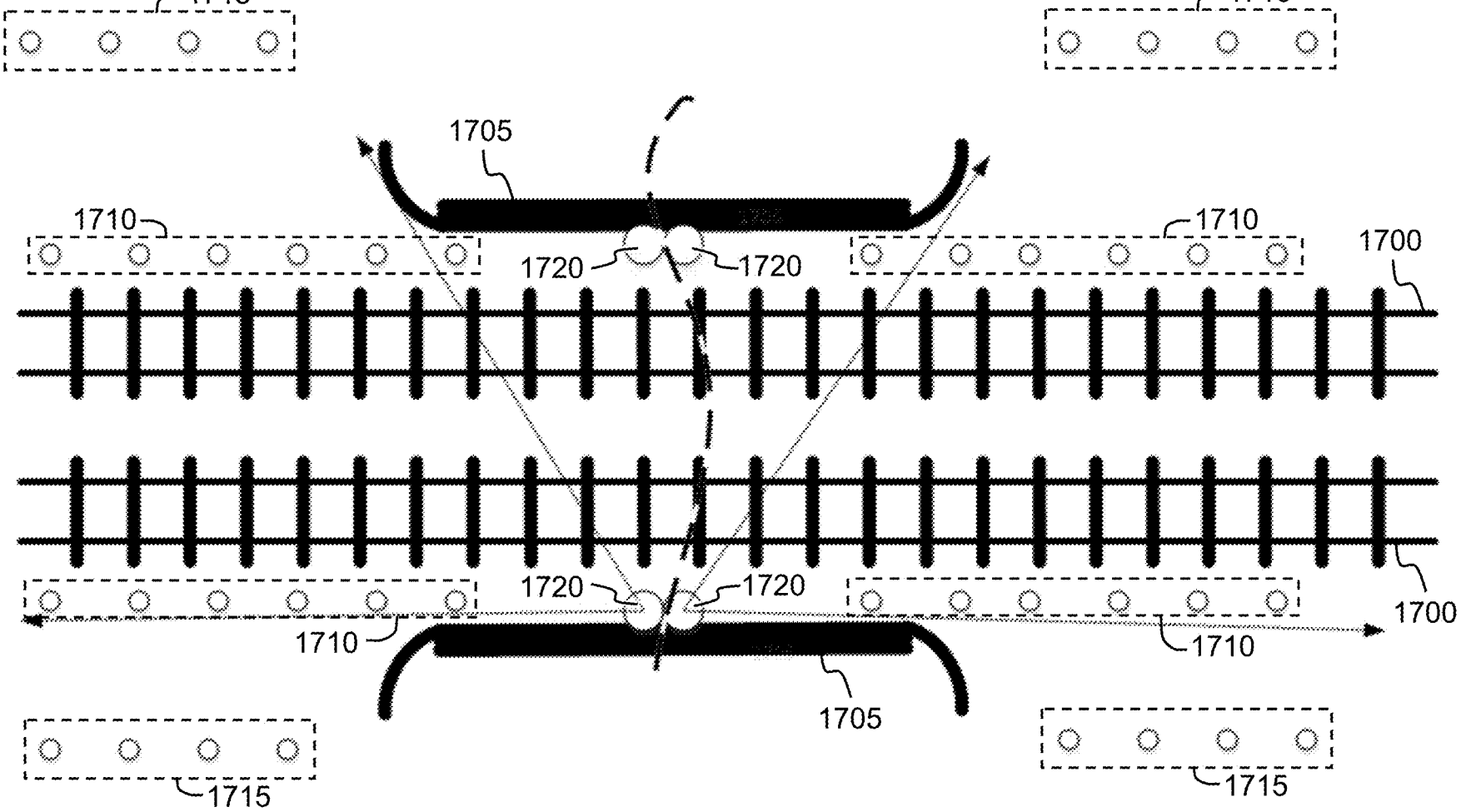
FIG. 17 illustrates a top elevation view of an embodiment of the system involving tunnels and/or trenches.

FIG. 17 depicts an IDS node installation within and near a trench or tunnel. The tracks 1700 pass below the level of the surrounding terrain, through a superstructure 1705 consisting of either open retaining walls (trench) or a full enclosing culvert (tunnel). The primary hazard in this scenario comes from debris—for example, stones or mud—which descends on the tracks from the surrounding terrain.

The track area can be surrounded at its perimeter with an array of geophones 1710, which are capable of sensing minute tremors in the earth resulting from falling or rolling objects. The geometry of the layout for the geophones 1710 can provide for localizing the center of the impact by comparing the signals from neighboring geophones 1710 in the array. A further distance from the rails, arrays of soil stability sensors 1715—for example, pore pressure sensors—can monitor movements of the surface soil uphill from the tracks 1700, to detect landslide or mud slide activity. Within the tunnel or trench, a set of multi-spectral imaging sensors 1720 can be mounted such that their fields of view overlap, providing in the summation a field of view encompassing the entire track area in the vicinity of the tunnel or trench 1705. By fusing the signals from the geophones 1710, soil stability sensors 1715, and multi-spectral imagers 1720, the IDS node can detect any material encroaching on the rails from the surrounding terrain.

Figure 18:
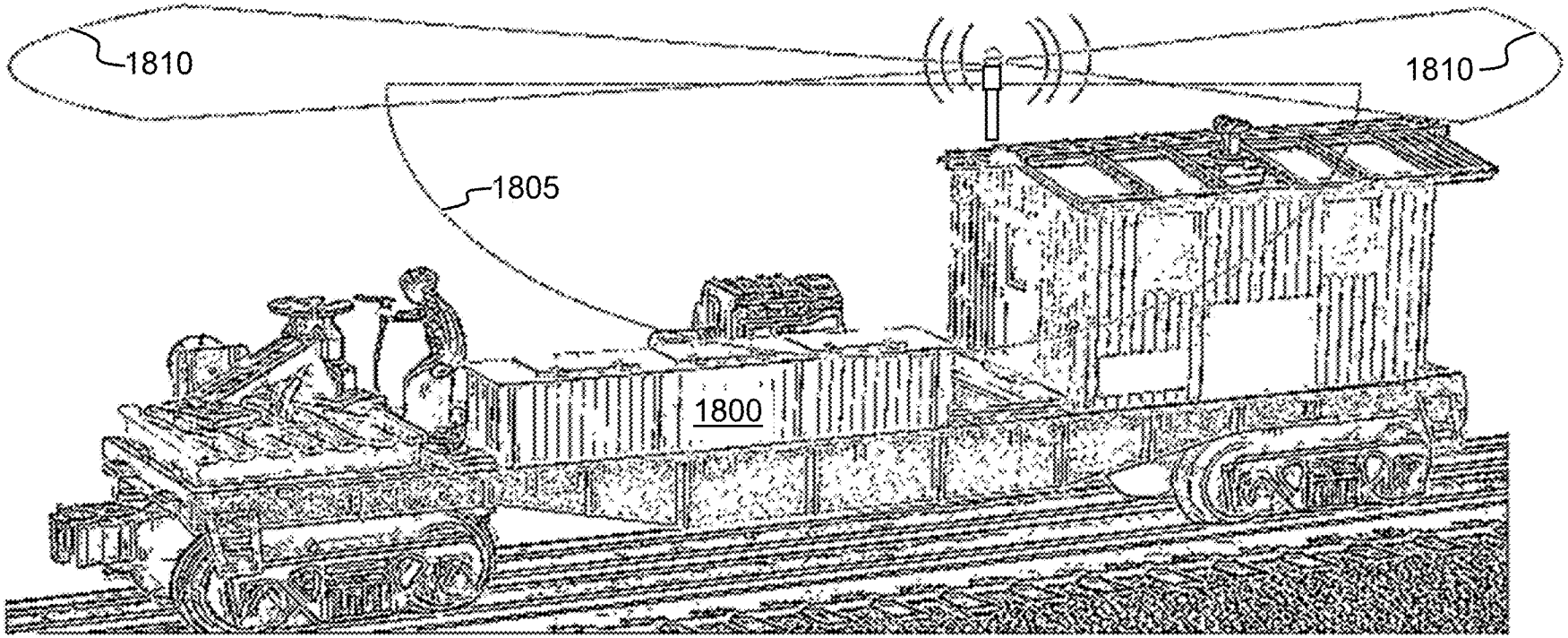
FIG. 18 illustrates an embodiment of the system mounted on a vehicle for maintenance-of-way.

FIG. 18 depicts an alternate embodiment in which an intrusion detection system node described herein is mounted on a moving rail vehicle, in this case a maintenance of way vehicle 1800. In this scenario, the primary hazards are from either close-by objects which are within the fouling zone of the vehicle 1800 or objects on the track ahead or behind, which may be far away. Visible imagery, IR imagery and/or short-range LIDAR 1805 can be used to monitor the space near the vehicle 1800 within the fouling perimeter. Long-range, narrow-beam LIDAR or RADAR 1810 can be used to monitor the track area ahead and behind the vehicle 1800, over the long distance required for safe vehicular stopping.

Figure 19:
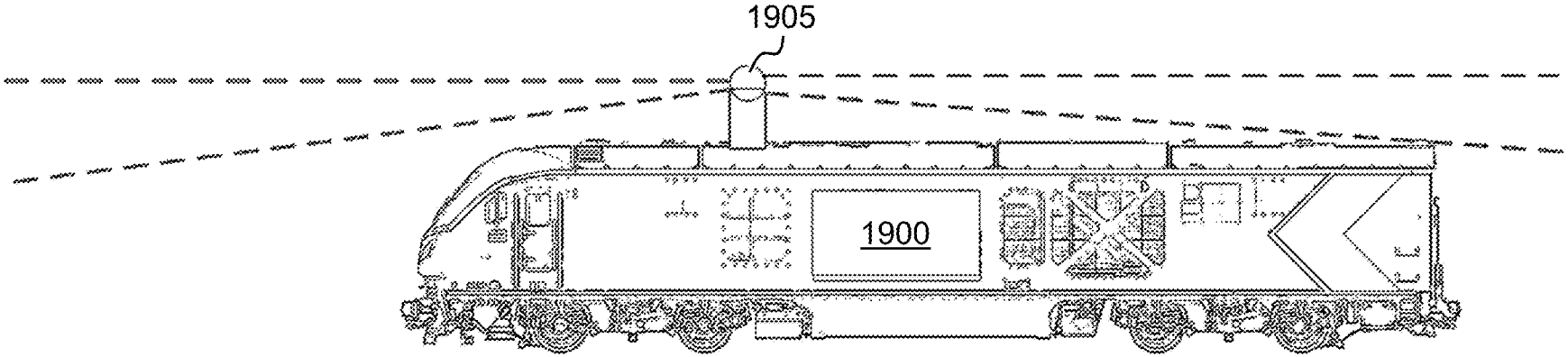
FIG. 19 illustrates an embodiment of the system mounted on a passenger car.

FIG. 19 depicts an alternate embodiment in which the intrusion detection system node is mounted on a passenger locomotive 1900. In this case, the IDS node 1905 can use long-range scanning (e.g., long-range, narrow-beam LIDAR or RADAR) to monitor the track ahead for obstacles. In this embodiment, the locomotive 1900 also can include visible imagery, IR imagery and/or short-range LIDAR as illustrated in FIG. 18 to enable monitoring when the locomotive is stationary, or operating at a slow speed, e.g., at a railroad station.

Figure 20A:
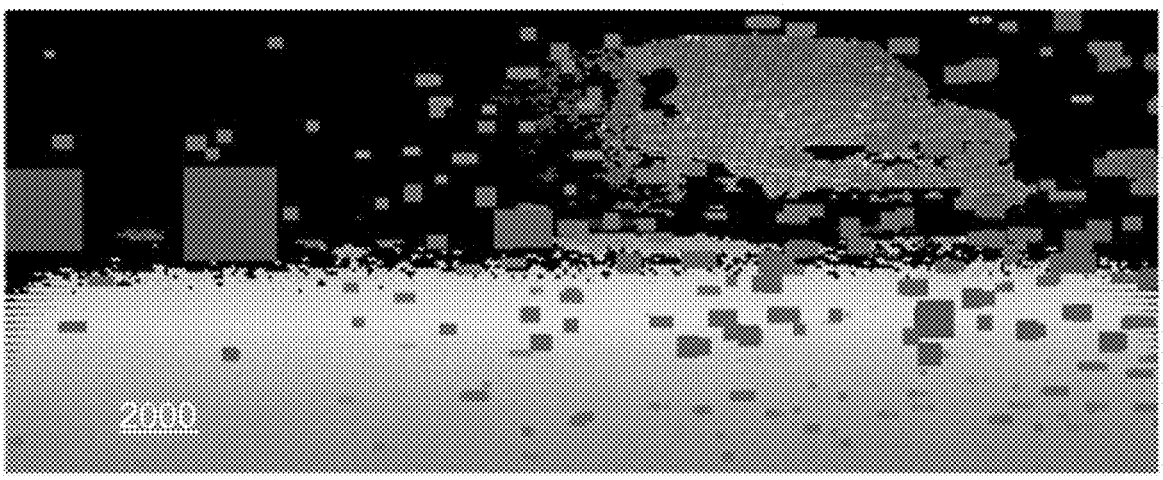
FIGS. 20A-20E illustrate use of median filtering to remove snow or other precipitation from images according to an embodiment.
Figure 20B:
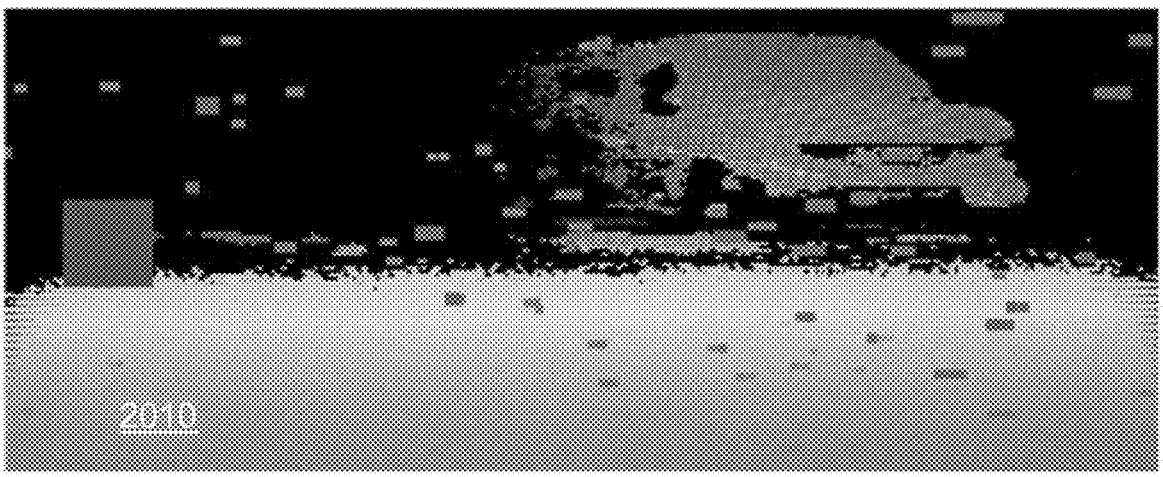
Figure 20C:
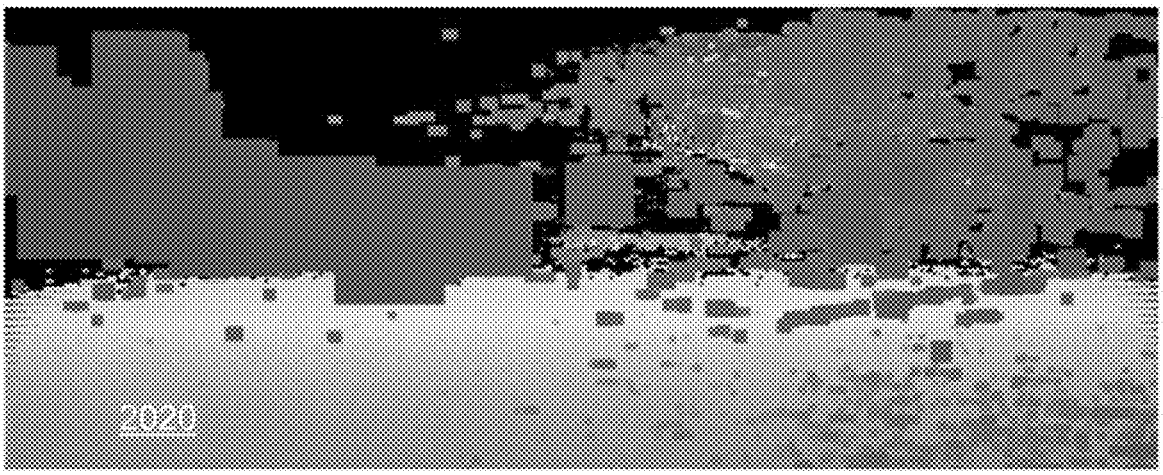
Figure 20D:
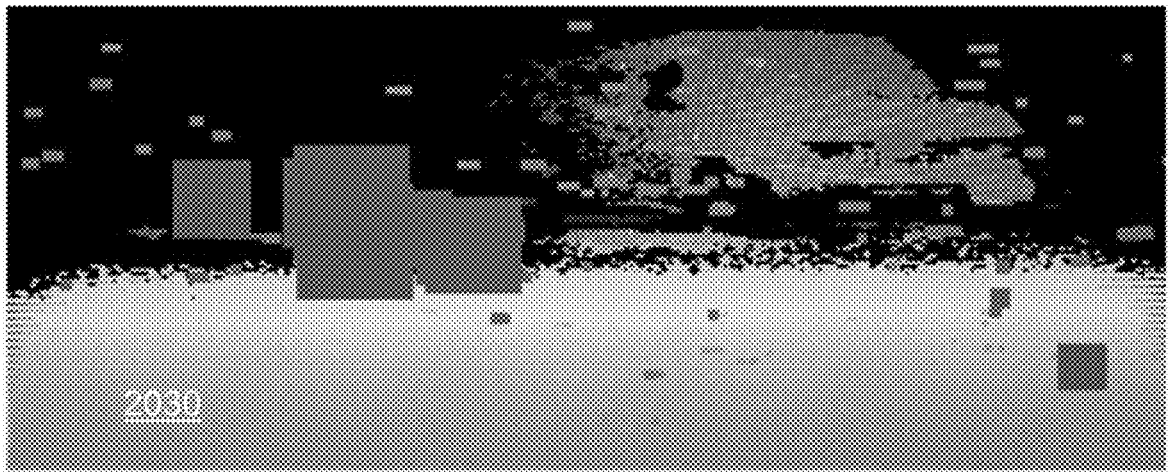
Figure 20E:
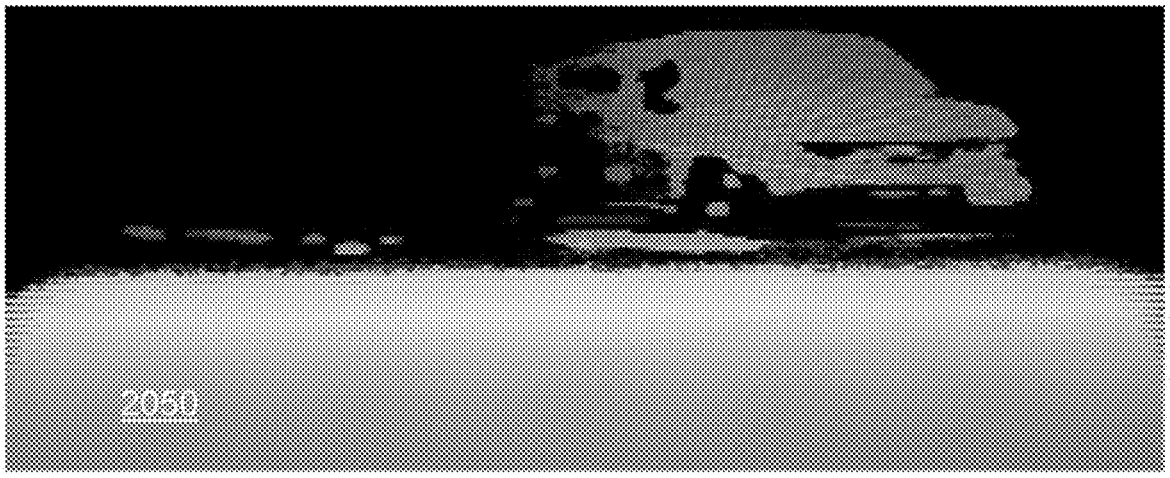

FIGS. 20A-20D depict four depth maps 2000, 2010, 2020 and 2030, respectively, of a vehicle in a parking lot during in the presence of falling and blowing snow. The depth maps are acquired, in rapid succession, from measurements from a LiDAR camera. Objects of interest in the depth map are obscured by the presence of falling snow, which causes the dark red areas to appear in each of the depth maps 2000, 2010, 2020 and 2030. By processing a time series of depth map images with a noise reducing filter (for example: a temporal median filter), an IDS node described herein can remove particulates like snowflakes, resulting in the depth map 2050 shown in FIG. 20E where the objects of interest are visible. Such techniques can be applied to other forms of precipitation as well as other scene-interfering particles (e.g., fog, smoke, etc.).

The foregoing description of various embodiments of this invention has been presented for purposes of illustration and description. It is not intended to be exhaustive or to limit the invention to the precise form disclosed and inherently many more modifications and variations are possible. All such modifications and variations that may be apparent to persons skilled in the art that are exposed to the concepts described herein or in the actual work product, are intended to be included within the scope of this invention.

What is claimed is:

1. A system for detecting intruding objects in a monitored area, the system comprising:

at least one intrusion detection sensing node including:

at least one sensor for acquiring sensor data for a monitored area; and a computing device configured to process the sensor data and generate intrusion detection data, wherein the at least one sensor provides the sensor data for processing by the computing device using at least two redundant sensor communications links; and a base station configured to receive intrusion detection data from the at least one intrusion detection sensing node via one of a plurality of node communications links, wherein the plurality of node communications links include a primary node communications link by which communications are first attempted and at least one backup node communications link for enabling communications when the primary communications link fails.

2. The system of claim 1, wherein the computing device includes at least two redundant controllers, wherein each redundant controller independently processes the sensor data received from a unique one of the at least two redundant sensor communications links to generate intermediate intrusion detection data.

3. The system of claim 2, wherein the computing device further includes a voting module, wherein the voting module evaluates the intermediate intrusion detection data generated by each of the at least two redundant controllers and outputs one of:

intrusion detection data or a failure, based on the evaluation.

4. The system of claim 2, wherein the computing device further includes:

at least one interface diagnostic module for monitoring each interface for the at least two redundant sensor communications links, and at least one watchdog module for monitoring each of the at least two redundant controllers.

5. The system of claim 1, wherein the at least one sensor includes at least one of: a vibration sensor, a visible and/or long wave infrared camera, a near infrared camera, an infrared camera, a short wave infrared light detection and ranging system, or a microwave radio detection and ranging sensor.

6. The system of claim 1, wherein the at least one sensor includes a first sensor for acquiring sensor data corresponding to a first sensing modality and a second sensor for acquiring sensor data corresponding to a second sensing modality distinct from the first sensing modality, and wherein the computing device fuses the sensor data acquired by the first sensor and the second sensor.

7. The system of claim 1, wherein the at least one intrusion detection sensing node is mounted on a rail vehicle.

8. The system of claim 1, wherein the monitored area is an area including a railroad.

9. The system of claim 1, wherein the base station is further configured to process the intrusion detection data received from the at least one intrusion detection sensing node to generate analysis results relating to an intrusion.

10. The system of claim 9, wherein the base station provides at least one of:

the analysis results or instructions based on the analysis results, for use by a remote user and/or for processing by a remote computing device.

11. A system for detecting intruding objects in an area including a railroad, the system comprising:

a plurality of intrusion detection sensing nodes, each intrusion detection sensing node including:

at least one sensor for acquiring sensor data for a monitored area; and a computing device configured to process the sensor data and generate intrusion detection data, wherein the at least one sensor provides the sensor data for processing by the computing device using at least two redundant sensor communications links; and a base station configured to receive intrusion detection data from each of the plurality of intrusion detection sensing nodes via one of a plurality of node communications links and process the intrusion detection data to generate analysis results relating to an intrusion of the area, wherein the plurality of node communications links include a primary node communications link by which communications are first attempted and at least one backup node communications link for enabling communications when the primary communications link fails.

12. The system of claim 11, wherein the computing device for each intrusion detection sensing node includes at least two redundant controllers, wherein each redundant controller independently processes the sensor data received from a unique one of the at least two redundant sensor communications links to generate intermediate intrusion detection data.

13. The system of claim 12, wherein the computing device for each intrusion detection sensing node further includes a voting module, wherein the voting module evaluates the intermediate intrusion detection data generated by each of the at least two redundant controllers and outputs one of: intrusion detection data or a failure, based on the evaluation.

14. The system of claim 11, wherein the intrusion detection data received by the base station is based on sensor data acquired using a plurality of different sensing modalities.

15. The system of claim 14, wherein the plurality of different sensing modalities includes at least two of: vibration sensing, imaging, and range detecting.

16. The system of claim 11, wherein the area includes at least one of: an overpass, an underpass, a trench, or a tunnel, for the railroad.

17. A method of detecting intruding objects in a monitored area, the method comprising:

acquiring, on a computing device for an intrusion detection sensing node, sensor data for the monitored area from at least one sensor, wherein the at least one sensor provides the sensor data for processing by the computing device using at least two redundant sensor communications links;

processing, with the computing device for the intrusion detection sensing node, the sensor data to generate intrusion detection data;

providing, for processing on a base station, the intrusion detection data via one of a plurality of node communications links, wherein the plurality of node communications links include a primary node communications link by which communications are first attempted and at least one backup node communications link for enabling communications when the primary communications link fails.

18. The method of claim 17, further comprising processing, by the base station, the intrusion detection data to generate analysis results relating to an intrusion of the monitored area.

19. The method of claim 18, further comprising the base station providing at least one of: the analysis results or instructions based on the analysis results, for use by a remote user and/or for processing by a remote computing device.

20. The method of claim 17, wherein the processing includes:

each of a plurality of redundant controllers independently processing the sensor data received from a unique one of the at least two redundant sensor communications links to generate intermediate intrusion detection data; and a voting module evaluating the intermediate intrusion detection data generated by each of the plurality of redundant controllers, wherein the computing device outputs one of: intrusion detection data or a failure, based on the evaluation.

* * * * *